US012286139B2

(12) United States Patent
Neeley

(10) Patent No.: US 12,286,139 B2
(45) Date of Patent: Apr. 29, 2025

(54) CATENARY ARM FABRICATION AND INSTALLATION RAIL CAR CONSIST FOR OVERHEAD CATENARY SYSTEMS

(71) Applicant: Herzog Railroad Services, Inc., St. Joseph, MO (US)

(72) Inventor: Aaron Q. Neeley, St. Joseph, MO (US)

(73) Assignee: Herzog Railroad Services, Inc., St. Joseph, MO (US)

( * ) Notice: Subject to any disclaimer, the term of this patent is extended or adjusted under 35 U.S.C. 154(b) by 0 days.

(21) Appl. No.: 18/406,024

(22) Filed: Jan. 5, 2024

(65) Prior Publication Data

US 2024/0227875 A1 Jul. 11, 2024

Related U.S. Application Data

(60) Provisional application No. 63/478,798, filed on Jan. 6, 2023.

(51) Int. Cl.
*B61D 15/00* (2006.01)

(52) U.S. Cl.
CPC ..... *B61D 15/00* (2013.01)

(58) Field of Classification Search
CPC ..... B61D 15/00; B61D 15/02; B61D 15/08; B61D 15/105; B61D 15/12; B61D 15/125
See application file for complete search history.

(56) References Cited

U.S. PATENT DOCUMENTS

| | | | | |
|---|---|---|---|---|
| 4,213,596 | A | 7/1980 | Inoue et al. | |
| 5,114,119 | A * | 5/1992 | Theurer | B60M 1/28 254/134.3 R |
| 6,007,050 | A | 12/1999 | Theurer et al. | |
| 6,193,215 | B1 | 2/2001 | Glemet | |
| 6,896,243 | B2 | 5/2005 | Theurer et al. | |
| 10,661,681 | B2 | 5/2020 | Nitti et al. | |
| 11,065,982 | B2 | 7/2021 | Morvillo et al. | |

(Continued)

FOREIGN PATENT DOCUMENTS

| | | |
|---|---|---|
| CN | 103129568 A | 6/2013 |
| CN | 109305178 A | 2/2019 |

(Continued)

*Primary Examiner* — Robert J McCarry, Jr.
(74) *Attorney, Agent, or Firm* — AVEK IP, LLC; Kent R. Erickson

(57) ABSTRACT

A catenary installation consist for construction of an overhead catenary system. The consist includes gondola-style cars with rails mounted along sidewalls thereof to enable wheeled apparatus to move therealong. The cars are configured for fabrication, storage, and installation of catenary arms as well as cable terminations. Wheeled lifting apparatus are disposed on several of the segments and can travel between cars to obtain materials and to reach desired installation locations. Movability longitudinally of the apparatus provides great latitude to crews for completing installation activities without need to move or precisely position the consist as a whole. Fabrication facilities enable construction of catenary arms on the consist as needed to meet design characteristics of particular installations. A crew-segment is also included and provides restrooms, shelter, and other needs for crew members to increase crew member comfort and time on site.

17 Claims, 11 Drawing Sheets

(56) References Cited

U.S. PATENT DOCUMENTS

| | | | |
|---|---|---|---|
| 2014/0216295 | A1 | 8/2014 | Herzog et al. |
| 2018/0208215 | A1 | 7/2018 | Zamorano Morfín |

FOREIGN PATENT DOCUMENTS

| | | | |
|---|---|---|---|
| CN | 109854062 | A | 6/2019 |
| CN | 209410059 | U | 9/2019 |
| CN | 210105438 | U | 2/2020 |
| CN | 111976547 | A | 11/2020 |
| CN | 112046339 | A | 12/2020 |
| CN | 212353684 | U | 2/2021 |
| CN | 212449993 | | 2/2021 |
| CN | 112046341 | B | 8/2021 |
| CN | 109278771 | B | 8/2023 |
| DE | 202008008711 | U1 | 10/2008 |
| EP | 0713799 | B1 | 3/1999 |
| EP | 1231097 | A1 | 8/2002 |
| EP | 1889770 | A1 | 2/2008 |
| EP | 0972669 | B1 | 8/2008 |
| EP | 1211122 | B1 | 12/2010 |
| EP | 3456601 | A1 | 3/2019 |
| EP | 3521126 | A1 | 8/2019 |
| FR | 3089165 | A1 | 6/2020 |
| GB | 2260033 | A | 3/1993 |
| SU | 1766728 | A1 | 10/1992 |
| WO | 9215470 | A1 | 9/1992 |
| WO | 2011141089 | A2 | 11/2011 |
| WO | 2018210533 | A1 | 11/2018 |

* cited by examiner

CATENARY ARM FABRICATION AND INSTALLATION RAIL CAR CONSIST FOR OVERHEAD CATENARY SYSTEMS

CROSS REFERENCE TO RELATED APPLICATIONS

This application claims the benefit of U.S. Provisional Patent Application Ser. No. 63/478,798, entitled POLE-SETTING AND CATENARY ARM FABRICATION AND INSTALLATION CONSISTS FOR OVERHEAD CATENARY SYSTEMS, filed Jan. 6, 2023, the disclosure of which is incorporated herein in its entirety by reference.

BACKGROUND

Overhead cable or catenary systems are common in electrical traction rail systems for providing electrical power to traction engines. The overhead cable systems typically include a series of poles or masts disposed spaced apart alongside a railway or tracks. The poles each carry an arm, which may also be referred to as a catenary arm or simply a catenary, that extends toward and/or over the tracks and supports a variety of cables including a contact cable and a messenger cable. Negative return and ground or earth cables are also often installed on the pole. Each of the cables extends from one pole or catenary to the next longitudinally along the length of the tracks.

The contact cable is suspended from the arm so as to be contacted by a pantograph of a traction engine traveling thereunder to transfer electrical power to the engine. The messenger cable is suspended above or away from the contact cable so as not to be contacted by the pantograph. The messenger cable is electrically coupled to the contact cable by jumpers provided at one or more of the arms to supply electrical power to the contact cable. The cables are pulled in tension during installation and the tension is maintained by weighted tension assemblies and/or fixed terminations at one or both of their terminating ends. The negative return and ground cables are typically installed on insulators coupled to the poles near a top end thereof.

Current installation practices for installing poles and negative return and ground cables of overhead catenary systems use a plurality of road-based vehicles which may be fitted with hi-rail systems that enable travel along the tracks of a rail system. For example, a typical installation team may include one or more delivery vehicles or semi-tractor trailers that transport the poles to their intended installation locations or as near as possible to such locations. In many instances the terrain or other obstacles prevent the delivery vehicles from reaching the installation locations, and thus the poles must be transported from a drop-off location to the final installation location by another smaller or rail-bound vehicle.

One or more crews of installers employ pole-setting vehicles such as flat-bed trucks with integrated crane arms or other lifting apparatus to transport the poles from the drop-off location to the final installation locations and to lift the poles into position for installation on a previously installed base or foundation. The crew may install travelers or blocks for the negative return and ground cables on the poles as well as the catenary arm among other components on the poles prior to or following installation of the pole on the base. Additional vehicles may be required to lift one or more crew members for installation of components on the poles. The pole-setting vehicles and any additional vehicles must be provided access to the installation locations via travel alongside the tracks or be configured for travel along the tracks. These vehicles are typically equipped with outriggers which must be deployed and retracted at every installation location for use of their associated crane arm or bucket lift.

Another crew follows the pole-setting vehicles to string the negative return and ground cables on the poles. This crew may include a first vehicle that carries and feeds out the cables and a second vehicle that follows behind to lift crew members to the top of the poles for installation of travelers, blocks, or the like for linking the cables with the poles. The travelers or blocks generally comprise a pulley through which the cable is threaded to allow the cable to be pulled into tension at a later time.

One or more additional finishing crews may follow to complete remaining installation steps such as installing terminations and balance weight assemblies that provide tension in the cables, replacing the travelers or blocks with insulators to affix the cables to the poles, and making electrical couplings of the cables.

Such installation teams may require greater than twenty vehicles to accommodate the crews and their activities just for installation of the poles and the negative return and ground cables. Each of the vehicles must be driven to and from the installation locations daily and stored overnight at another location which may be miles from the installation location. Travel to the installation location may require additional travel due to accessibility issues surrounding the installation locations and roadway access thereto. Additionally, crew members must be provided with restroom and break facilities during the workday which may require additional travel to and from the installation site. These aspects, among others, lead to a great deal of inefficiency, logistical problems, and large overhead and equipment costs.

Rail-bound vehicles have been developed to reduce some of the accessibility issues associated with such installations, however issues associated with the number of required vehicles, daily travel requirements, and crew requirements, among others, persist. One such exemplary rail-bound configuration is depicted in PCT Patent Application Publication No. WO2011141089 ('089) to Theurer and Fletzer. The '089 publication depicts a plurality of separate rail-bound vehicles each configured to carry out a particular step in installation of an overhead catenary system. Most of the vehicles include flat-bed cars that carry the components to be installed and articulated lifting arms affixed to one of the cars. Additional, separate vehicles are provided to carry and pay out the cables as well as to raise crew members to the erected masts for installation of the cables thereon. Each of these vehicles must be independently driven along the tracks to the various installation locations in sequence to carry out their designated tasks and each carries crew and supplies needed for such installations. Additionally, separate rail- and/or non-rail-bound vehicles are likely required to provide transportation and accommodation for crew members before, during, and after working hours.

Completion of the build out of the catenary system requires installation of catenary arms on the poles as well as stringing of the contact and messenger cables thereon. Additional crews of installers with equipment configured similarly to that described previously transport the catenary arms to the install locations and raise and mount the catenary arms on the poles. The contact, messenger, and any other desired cables must also be played out, raised up to and coupled with the catenary arms, and tensioned which may include installation of static anchors, or weighted tensioning assemblies, among others.

Available equipment and systems used for installation of the catenary arms and cables suffer similar drawbacks and shortcomings as those used for the pole-setting tasks described above. These drawbacks include the great number of crew members and equipment required to complete the tasks, transport and storage of the equipment and materials to and from the installation location, and the need for accommodations for the crew members, among others.

SUMMARY

A high-level overview of various aspects of exemplary embodiments is provided here to introduce a selection of concepts that are further described in the Detailed-Description section below. This summary is not intended to identify key features or essential features of embodiments, nor is it intended to be used in isolation to determine the scope of the described subject matter. In brief, this disclosure describes a pole-setting consist for installing poles or masts and negative return and ground cables of overhead catenary systems and a catenary arm fabrication and installation consist that can follow the pole-setting consist to complete the build out of the overhead catenary system.

The pole-setting consist comprises a series of rail-bound cars coupled together to form a consist that can be coupled to or include a motive means, such as a locomotive or other powered rail-bound vehicle. The consist includes a pole-setting segment, a crew-segment, a cable-deployment segment, and a cable-stringing segment.

The pole-setting segment includes a plurality of gondola-cars in which a supply of poles may be disposed and carried to the installation locations. Top edges of the gondola-car's longitudinally extending walls or sidewalls are provided with a rail upon which wheels of a pole-handling apparatus may traverse and bridge members are provided between the sidewalls of adjacent ones of the gondola-cars to allow travel of the pole-lifting apparatus therebetween. The pole-handling apparatus includes an articulated arm with an end-arm tool configured to lift and position the poles from within a cargo area of the gondola-car to a base or foundation alongside the consist for installation thereof.

The crew-segment comprises one or more cars and includes one or more portable restroom facilities and an enclosed breakroom or office, among other facilities for use by the crew.

The cable-deployment segment comprises a plurality of gondola-cars configured to carry a plurality of coils of cables for installation as the negative return and ground cables of the overhead catenary system. The gondola-cars of the cable-deployment segment are configured like those of the pole-setting segment to include rails on which a cable-lifting apparatus may travel. The cable-lifting apparatus includes an articulated arm with an end-arm tool configured to position and feed out the negative return and the ground cables for coupling with the poles as the consist travels along the tracks. The cable-lifting apparatus may also be configured to move coils of the cables from within the gondola-cars to a cable reel or stand when a previous coil is exhausted.

The cable-stringing segment follows the cable-deployment segment and comprises one or more similarly configured gondola-cars on which a man-lift apparatus is disposed. The man-lift is fitted with wheels and is moveable along the rails of the gondola-car sidewalls to move longitudinally along the cable-stringing segment. Crew members can thus be lifted to the poles to install travelers, insulators, and/or other components on the poles and/or to install the cables in the travelers and/or insulators.

Exemplary embodiments may also include a catenary arm fabrication and installation consist, hereinafter referred to as the catenary consist, that can follow the pole-setting consist to complete the build out of the overhead catenary system. The catenary consist may be coupled to or be integrated with the pole-setting consist or may follow along separately. The cars forming the catenary consist comprise gondola and/or flat-bed cars configured similarly to those of the pole-setting consist and are arranged to include one or more crew-segments, a termination-installation segment, a catenary arm-installation segment, an inventory-staging segment, a secondary-assembly segment, and a primary-fabrication segment. The crew-segments may be configured similarly to that described above with respect to the pole-setting segment.

The termination-installation segment includes an articulated boom or other lifting means configured to raise and aid installation and/or distribution of weighted termination assemblies at desired locations. Components and/or preassembled termination assemblies may be stored within a bay of the gondola car proximate to the boom. Both the termination-installation segment and the catenary arm-installation segment include one or more cars in which pre-fabricated catenary arms are stored and that are provided with one or more mobile man-lift devices configured to travel longitudinally along the sidewalls of the cars and between the cars. The man-lift devices are configured to raise one or more operators and a catenary arm from a storage location within the respective car to a mounting location on a previously installed pole alongside the tracks. The catenary arm-installation segment may also include a mobile gantry crane that is operable to transfer pre-fabricated catenary arms longitudinally along the consist for access by operators using the man-lift devices on the termination-installation segment and the catenary arm-installation segment.

The inventory-staging segment provides additional storage for pre-fabricated catenary arms and a stationary gantry crane that is operable to move the catenary arms toward the termination-installation and the catenary arm-installation segments. The inventory-staging segment may also provide storage for coils of cable for guy wires that can be distributed as the catenary consist moves along a route among other materials that need storage or distribution.

The secondary-assembly segment and the primary-fabrication segment each provide enclosures and facilities useable by crew members for fabrication of catenary arms and components needing assembly and installation on the catenary arms as well as storage for supplies and raw materials used in such fabrication. These segments enable fabrication of the catenary arms on the catenary consist and to specific specifications required by particular characteristics of the overhead catenary system.

A method for installing catenary system components on pre-installed poles for a catenary system includes providing a consist comprising a plurality of rail-bound cars coupled together to form a single unit, the cars of the consist being grouped to provide a catenary-installation segment, a termination-installation segment, a material lift on the termination-installation system and one or more manlifts which are configured to traverse across the tops of the cars of the catenary-installation segment and the termination-installation segment. The catenary-installation segment comprises at least one catenary-installation segment rail car having a catenary arm storage space for storing a plurality of catenary arms. The termination-installation segment comprises at least one termination-installation segment rail car having a termination component storage space for storing a plurality of termination components. The material lift disposed on the termination-installation segment may be an articulated arm type lifting apparatus adapted for gripping or otherwise releasably engaging and lifting termination components for installation. The one or more manlifts are configured to travel along the catenary-installation segment to raise at least one crew member and a selected catenary arm for installation on a pre-installed pole alongside the consist.

The method further comprises positioning a plurality of catenary arms in the catenary arm storage space of the at least one catenary-installation segment rail car then moving the catenary consist along a section of a railroad track to a desired location having one or more preinstalled catenary poles to which catenary arms are to be attached to position the catenary-installation segment adjacent to the one or more poles. The one or more manlifts are operated to raise at least one crew member per manlift and a selected catenary arm and position the crew member and the selected catenary arm proximate a pre-installed pole of the catenary system such that the crew member may connect the selected catenary arm to the pre-installed pole. operating the material lift to raise at least one of the plurality of termination components to proximate an installation location for the termination components proximate one of the preinstalled catenary poles. When a termination point for the catenary system to be installed is reached, the first manlift may be operated to travel across the termination-installation segment and position the crew members proximate the installation location to allow installation, by the at least one crew member, of the installation components raised by the material lift at or proximate the installation location corresponding to the termination point. Additional manlifts may be provided and are configured to travel along the catenary-installation segment. Each manlift is configures to raise at least one crew member and a selected catenary arm for installation on a pre-installed pole alongside the consist.

A catenary arm fabrication segment and an inventory-staging segment may also be provided on the consist. One or more cars of the catenary arm fabrication segment are provided with materials, tools and a work space to fabricate catenary arms. The inventory-staging segment comprises at least one staging segment rail car having a catenary arm staging space in which groups of catenary arms, each comprising a plurality of catenary arms supported or mounted on a support structure such as a rack or pallet or bin, may be placed or positioned. The groups of catenary arms are selectively moved from the catenary arm staging space to the catenary arm storage space of the at least one catenary-installation segment rail car. The manlifts are then operated to lift individual catenary arms from the catenary arm storage space to a position to facilitate installation on one of the pre-installed catenary arms.

Additional steps of the process for fabricating and installing components of a catenary system including termination components and the catenary arms are describe in the description set forth below.

DESCRIPTION OF THE DRAWINGS

Illustrative embodiments are described in detail below with reference to the attached drawing figures, and wherein.

DETAILED DESCRIPTION

Figure 1:
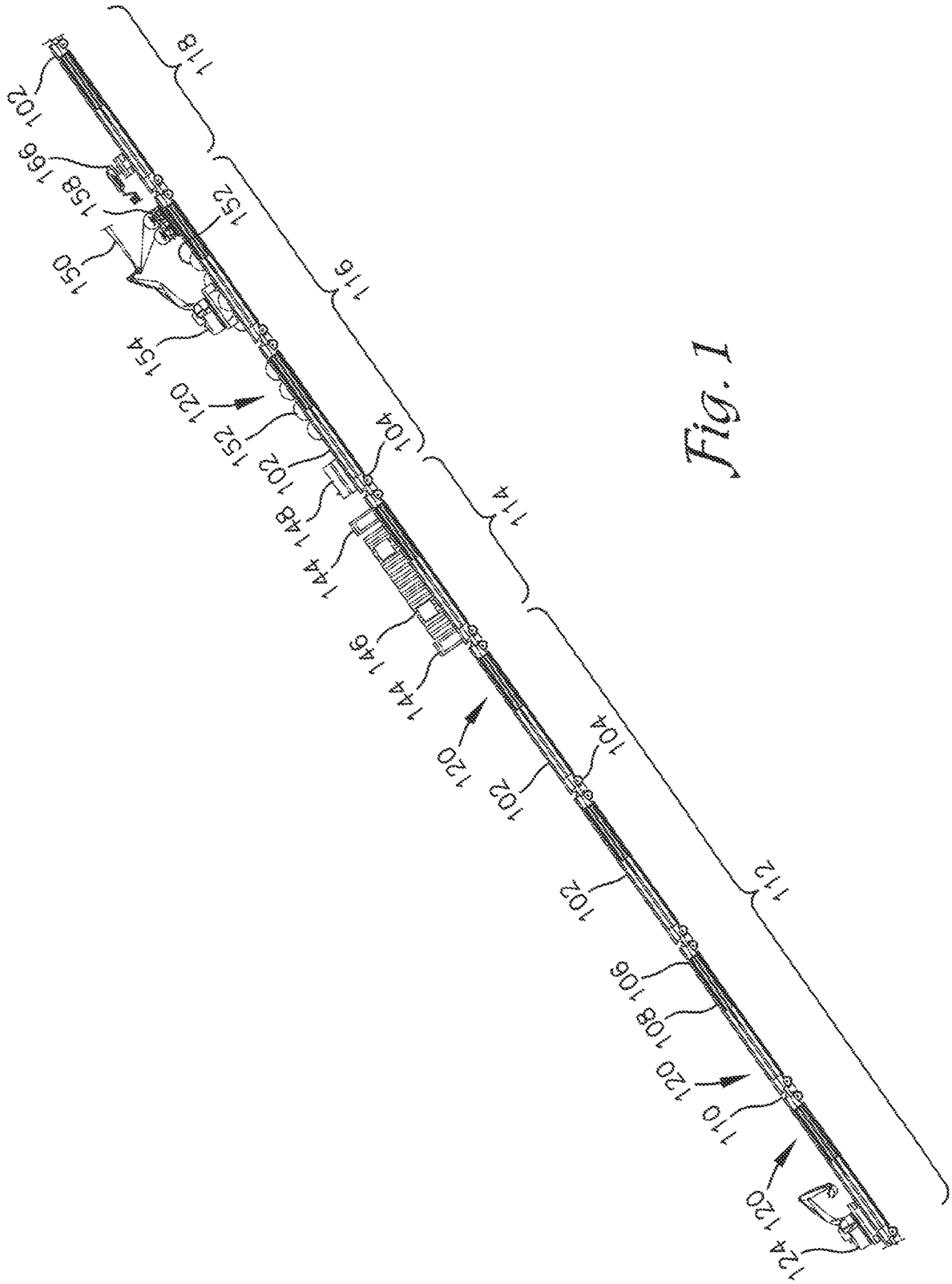
FIG. 1 is an elevational view of a pole-setting consist depicted in accordance with an exemplary embodiment.
Figure 2:
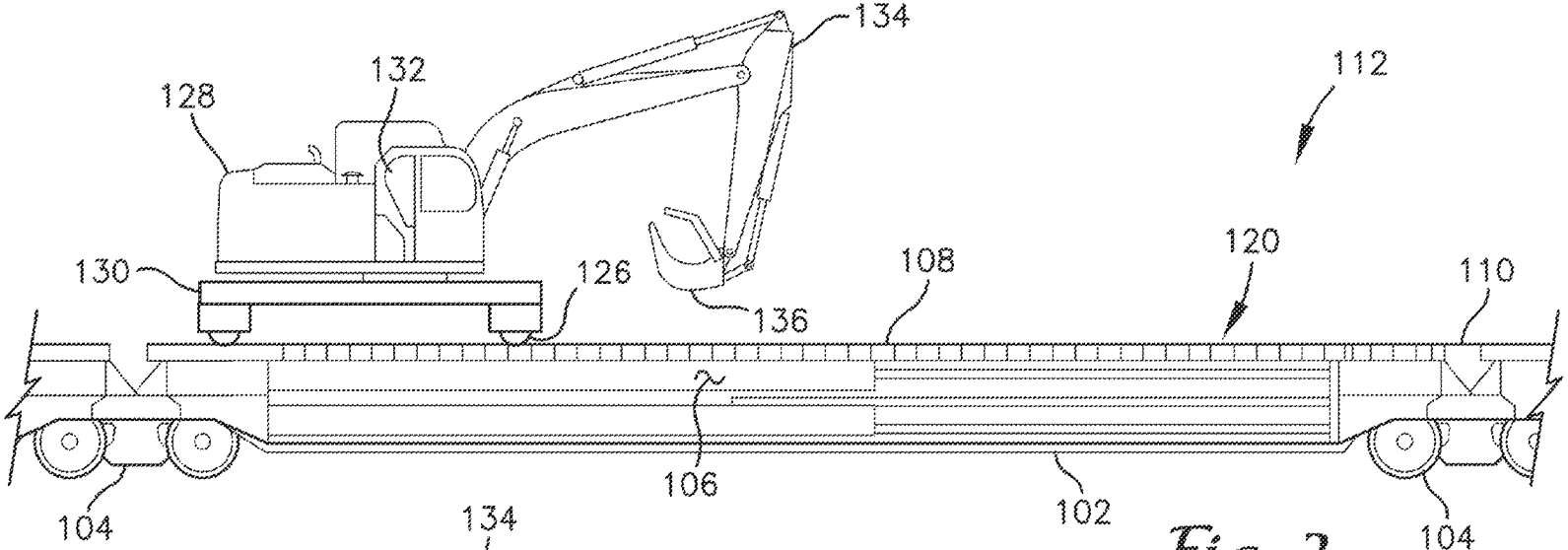
FIG. 2 is partial elevational view of a pole-setting segment of the pole-setting consist of FIG. 1.

The subject matter of select exemplary embodiments is described with specificity herein to meet statutory requirements. But the description itself is not intended to necessarily limit the scope of embodiments. Rather, the subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described. The terms "about" or "approximately" as used herein denote deviations from the exact value by +/−10%, preferably by +/−5% and/or deviations in the form of changes that are insignificant to the function.

With reference to FIGS. 1-7, a pole-setting consist 100 is described in accordance with an exemplary embodiment. The pole-setting consist 100, or simply the consist 100 comprises a plurality of rail-bound rail-cars 102 coupled together into a single unit or consist. As depicted in FIGS. 1-7, the rail-cars 102 are preferably comprised of a gondola-style car configuration but other styled cars, such as flat-cars might be employed. A gondola-style configuration includes a recessed cargo area extending along the length of the car 102 between a truck 104 or wheel-set disposed at and supporting each end thereof.

The cars 102 of the consist 100 are also preferably configured with a shared-truck configuration in which ends of adjacent ones of the cars 102 are supported on a single truck 104. Such a configuration decreases the overall weight of the consist 100, reduces or eliminates coupler slack between the cars 102, and may reduce a distance between the cars 102 and/or the overall length of the consist 100.

The cargo area of each car 102 is bounded on its longitudinal sides by a pair of vertical sidewalls 106. As known in the art, the sidewalls 106 are of a vertical height sufficient to form the cargo area but less than that of a common box-car or hopper car. The cargo area may be low slung to shift the cargo area and/or sidewalls vertically downward toward the tracks.

As depicted in FIGS. 1-7, the sidewalls 106 of exemplary embodiments are provided with a rail 108 disposed along the top vertical edge thereof. The rail 108 is configured to support and enable a wheeled apparatus to travel longitudinally along the sidewalls 106 as described more fully below. The rail 108 may take any desired form including that of a common railroad rail among a variety of other configurations. Bridging elements 110 may also be provided to extend the rails 108 between adjacent ones of the cars 102 of the consist and to allow wheeled apparatus to travel between the cars 102. The bridging elements 110 may be removeable and/or extensible to allow pivoting of the cars 102 relative to one another during transit of the consist 100 along the tracks.

The consist 100 comprises a plurality of segments that are each formed from one or more of the cars 102. Although discussed herein with respect to segments, the consist 100 is a continuous, single unit; segmentation of the consist 100 is merely used herein for clarity and ease of description and is based on the functions performed at different locations along the consist 100. The segments include a pole-setting segment 112, a crew-segment 114, a cable-deployment segment 116, and a cable-stringing segment 118. It is understood that although the segments and the functions performed thereby are described as being provided in a particular order, such is not intended to be limiting on the scope of exemplary embodiments. For example, the crew-segment 114 might be provided at a leading or trailing end of the consist 100, among other configurations.

The pole-setting segment 112 comprises a plurality of cars 102 configured as gondola-style cars as described previously above with a cargo area 120 and rails 108 provided along top edges of the sidewalls 106 thereof. Although four cars 102 are shown in the pole-setting segment 112 in FIG. 1, it is understood that the pole-setting segment 112 may include fewer or more cars 102 including at least one car 102 and more typically between two and ten cars 102. The cargo areas 120 of the cars 102 are of sufficient dimensions to receive and carry a plurality of poles 122 to be installed by the consist 100 (for example, like the poles 122 depicted in FIG. 3). The cargo areas 120 may include one or more features, such as tabs, flanges, shelves, slots, or the like configured to aid storage of the poles 122.

Atop the cars 102 of the pole-setting segment 112 is disposed a pole-handling apparatus 124. The pole-handling apparatus 124 comprises a wheeled vehicle configured to travel longitudinally along the consist 100 along the rails 108 on the sidewalls 106 of the cars 102. Wheels 126 of the pole-handling apparatus 124 may be flanged like those of common rail-bound vehicles or may take another configuration. For example, the pole-handling apparatus 124 may be configured with on-highway wheels and/or tires and include a hi-rail apparatus to adapt the pole-handling apparatus 124 for travel along the rails 108.

As depicted in the drawings, the pole-handling apparatus 124 includes a body 128 disposed on a platform 130 and rotatable relative thereto about a vertical axis. The body 128 includes an operator's cab 132 and an elongate arm 134 pivotably coupled thereto. The body 128 may house an engine, generator, and hydraulic pump among other components for powering the pole-handling apparatus 124, moving the apparatus 124 along the rails 108 of the cars 102, and manipulating the arm 134, among other functions. In one embodiment, the apparatus 124 may be remotely operated from elsewhere on or near the consist 100 by, for example an operator in a remote control-cab or using a wireless or wired control station. In another embodiment, the apparatus 124 may be at least partially electrically powered by a generator disposed at another location along the consist 100. In one embodiment, the apparatus 124 is configured similarly to an excavator disposed on the platform 130 which is specially adapted for travel on the cars 102.

Figure 3:
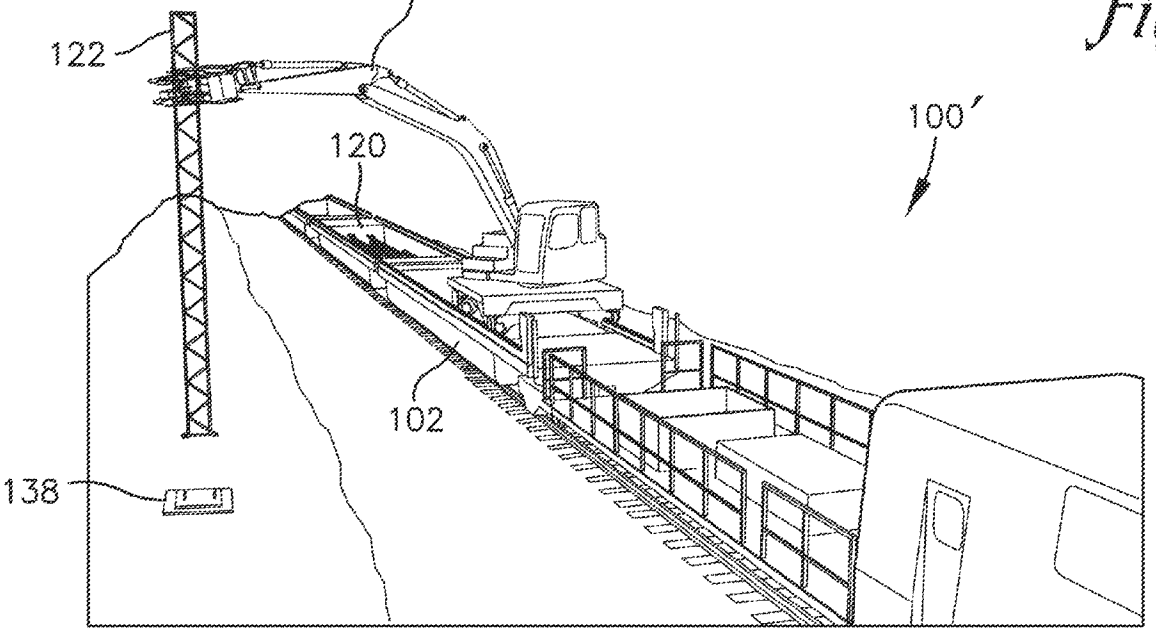
FIG. 3 is an illustrative perspective view of a pole-setting segment of a pole-setting consist depicted in accordance with an exemplary embodiment.

The arm 134 includes an end-arm tool 136 that is adapted to grasp the poles 122 disposed in the cargo areas 120 of the cars 102 of the pole-setting segment 112 and to lift the poles 122 into position on foundations 138 installed alongside the railway as depicted in FIG. 3. The arm 134 and the end-arm tool 136 may be configured in a variety of ways using various grasping mechanisms based on the type and characteristics of the pole 122 to be installed as well as to provide movement about multiple axes for proper placement of the pole 122 on the foundation 138.

Figure 4:
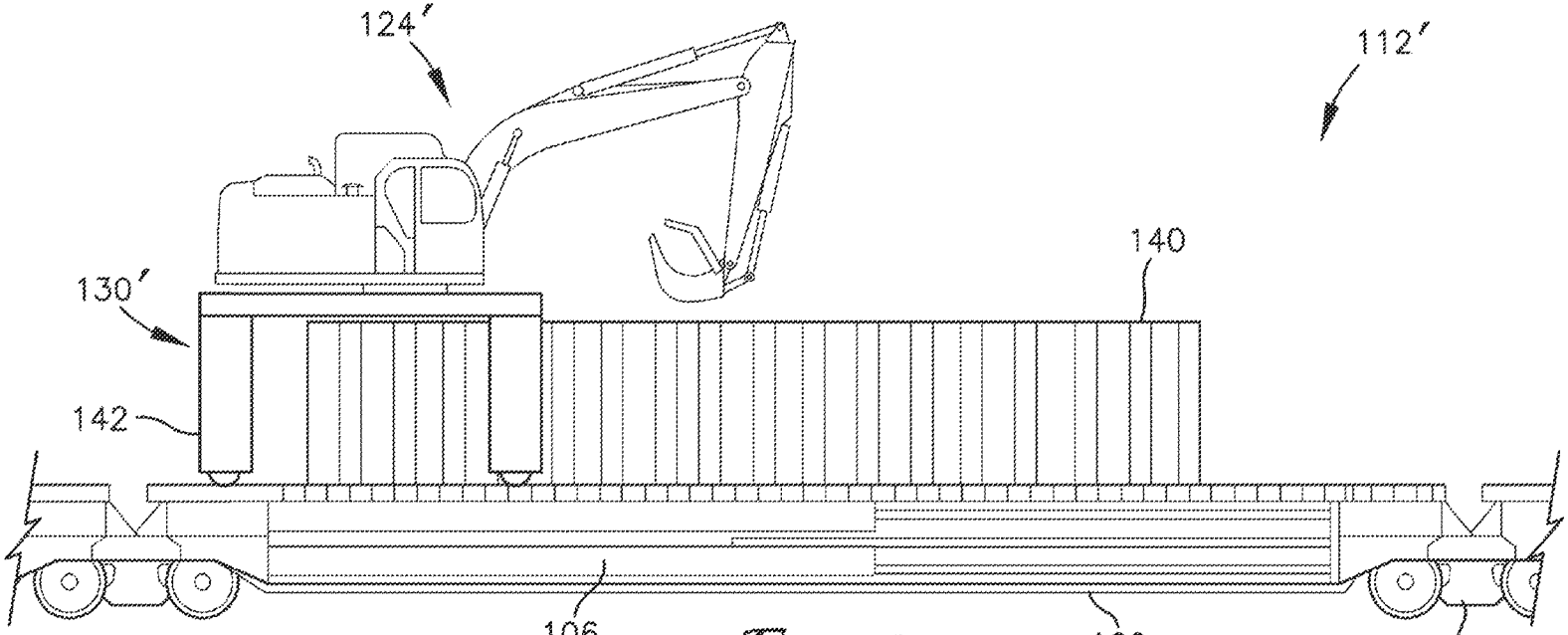
FIG. 4 is a partial elevational view of another pole-setting segment that includes an elevated lifting apparatus configured for use with containerized cargo depicted in accordance with another exemplary embodiment.

As depicted in FIG. 4, in some embodiments the poles 122 may be received from a manufacturer in an open-topped container 140. It may be beneficial and more time efficient to place such containers 140 into the cargo areas 120 of the cars 102 rather than unloading the poles 122 from the containers 140 and placing them into the cargo areas 120.

Accordingly, a pole-handling apparatus 124' may be configured with an elevated platform 130' which includes elongate legs 142. The legs 142 have length to raise the platform 130' to a height sufficient to allow the pole-handling apparatus 124' to pass over the containers 140 and to remove poles 122 from within the containers 140.

Figure 5:
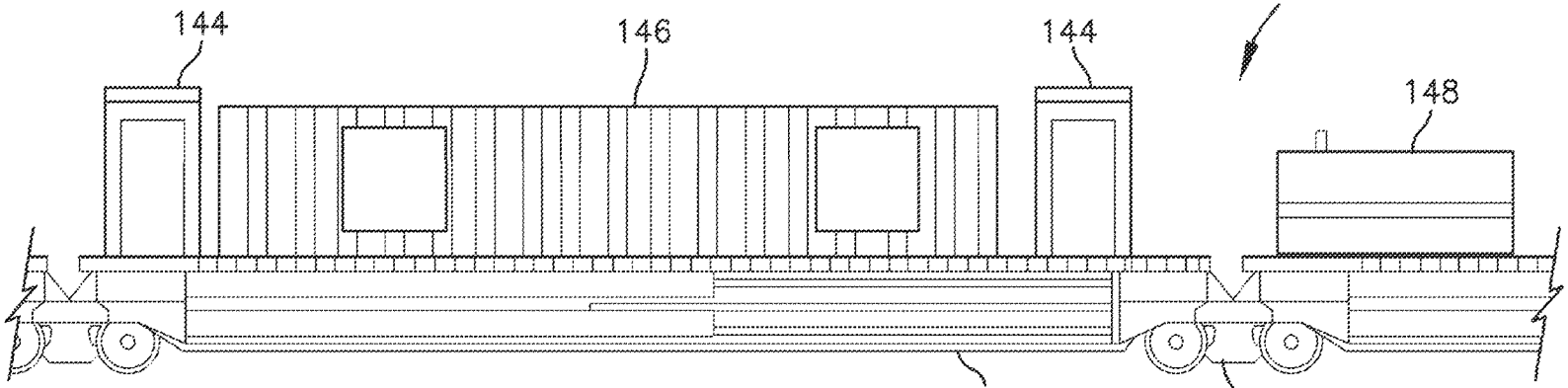
FIG. 5 is a partial elevational view of a crew-segment of the pole-setting consist of FIG. 1.

With reference now to FIG. 5, the crew-segment 114 includes a variety of accommodations which crew members may inhabit or occupy such as, for example and not limitation, restroom facilities 144 and an enclosed crew quarters 146. The crew quarters 146 may provide a variety of amenities including office and/or work space, sleeping/rest spaces, lockers and/or locker rooms, bathing facilities, kitchen and meal facilities and eating spaces, and communication or computing facilities, among others. Although only a single crew quarters structure 146 is depicted in the drawings, it is understood that additional structures 146 may be provided and the segment 114 may include additional cars 102 as needed to accommodate such structures 146.

As depicted in FIG. 5, the car 102 of the crew-segment 114 comprises a gondola-style car like those of the remainder of the consist 100 however the crew-segment 114 may utilize flatbed or other styled cars 102 as needed. The crew quarters structure 146 may be constructed from a cargo container or similar structure that can be placed into the cargo area of the gondola car 102 for ease of construction, however such is not required. In some embodiments, such a configuration enables travel of the pole-handling apparatus 124' over the crew quarters structure 146 and thus to either end of the crew-segment 114.

Also as depicted in FIG. 5, a generator 148 and associated equipment may be provided in the crew-segment 114 on the same or different car 102 as the crew-quarters structure 146. The generator 148 may be employed to provide power to the crew-segment 114 and/or to other operations on the consist 100.

Figure 6:
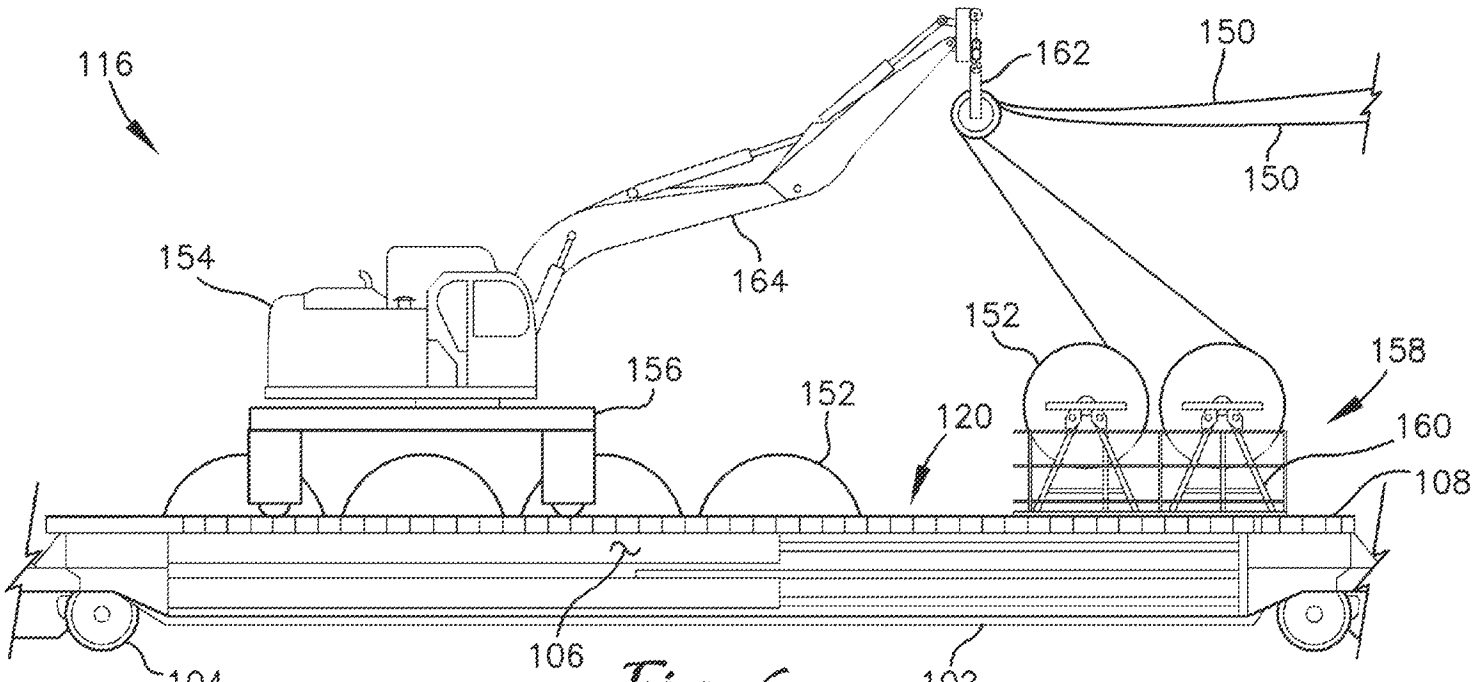
FIG. 6 is a partial elevational view of a cable-deployment segment of the pole-setting consist of FIG. 1.

With reference to FIG. 6, the cable-deployment segment 116 is configured to play out cables 150, such as the negative return and ground cables, and to carry a supply of spools 152 around which the cables 150 are wound. The gondola-cars of the cable-deployment segment 116 are coupled to the crew-segment 114 and configured like those of the pole-setting segment 112 to include rails on which a cable-lifting apparatus 154 may travel. Cargo areas 120 of the cars 102 in the cable-deployment segment 116 may include structures or features to aid holding or maintaining spools 152 disposed therein in secure positions during transit of the consist 100.

The cable-lifting apparatus 154 may have a substantially similar configuration to that of the pole-handling apparatus 124 or may take another configuration as needed based on the lifting and range-of-motion requirements thereof. As depicted in FIG. 6, the cable-lifting apparatus 154 includes an elevated platform 156 configured to enable travel of the cable-lifting apparatus 154 over the spools 152 disposed in the cars 102 of the cable-lifting segment 116. The elevated platform 156 may be the same as the elevated platform 130' of the pole-handling apparatus 124' described previously or may be modified based on the dimensions and handling characteristics of the spools 152 and cables 150.

At least one car 102 of the cable-deployment segment 116 includes a spool station 158. The spool station 158 provides a support structure 160 configured to hold one or more of the spools 152 and allow rotation thereof about a horizontal axis as the cable 150 is played out. The spool station 158 may include apparatus for controlling a rate at which the cable 150 is played out and/or to rotate the spool 152 to play out or retract the cable 150 as needed.

The cable-lifting apparatus 154 includes an end-arm tool 162 designed for raising the cables 150 to a desired height to aid coupling with the installed poles 122 and to aid playing out the cables 150 from the spools 152. The end-arm tool 162 may comprise free-wheeling pulleys or blocks around which the cables 150 are fed and directed toward desired installation locations. In one embodiment the end-arm tool 162 may engage the cables 150 separately or together and may be powered to aid drawing of the cables 150 from the spools 152 and playing out of the cables 150 toward the poles 122. The end-arm tool 162 may also be adapted to engage the spools 152 to lift the spools 152 from the cargo area 120 to the spool station 158 vice versa. Alternatively, the end-arm tool 162 may be disengaged from an arm 164 of the cable-lifting apparatus 154 and a second end-arm tool (not shown) engaged for moving the spools 152.

Figure 7:
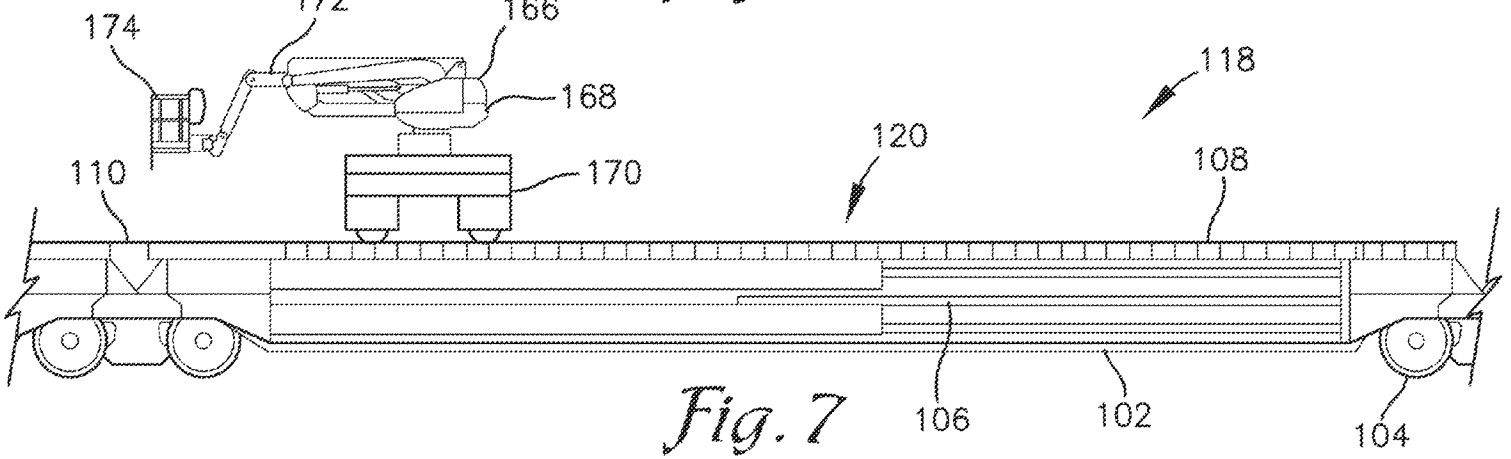
FIG. 7 is an elevational view of a cable-stringing segment of the pole-setting consist of FIG. 1.

FIG. 7 depicts the cable-stringing segment 118 which may be comprised of one or more of the cars 102 like those described above with rails 108 disposed along the sidewalls 106 thereof. The cars 102 of the cable-stringing segment 118 are preferably also gondola-style cars but other types of cars, including flat-bed cars may be employed. In some embodiments, the cargo areas 120 of the gondola-style cars 102 may be employed to store tools, materials, parts, and the like that may be needed for installation of the poles 122 and cables 150 as well as maintenance of the consist, among other operations.

The cable-stringing segment 118 includes a man-lift 166 disposed thereon and configured to travel along the rails 108 longitudinally along the segment 118. The man-lift 166 comprises body 168 mounted on a platform 170. The platform 170 may be configured similarly to the platforms 130, 130', and 156 to provide longitudinal movement of the man-lift 166 along the car 102, rotational motion of the body 168 relative to the platform 170 about a vertical axis, and to raise or elevate the body 168 to provide additional clearance for items placed in the cargo areas 120 of the cars 102. The body 168 houses engines, pumps, and other mechanical and electrical apparatus used for operation of the man-lift 166. In one embodiment, the man-lift 166 may be coupled to another source of electrical and/or hydraulic power disposed elsewhere on the consist 100, such as the generator 148.

An extensible and/or articulated arm 172 extends from the body 168 and includes a crew basket 174 disposed at a distal end thereof. The crew basket 174 is configured to hold one or more crew members and to lift the crew members to a desired height and location alongside the consist 100 for performance of their installation duties. The crew basket 174 may include a control station from which the crew members can operate the man-lift's longitudinal movement along the cars 102, rotation of the body 168 relative to the platform 170, and articulation and/or extension of the arm 172, among other functions. In one embodiment, a remote control may be provided to control operation of the man-lift from locations other than the crew basket 174.

With continued reference to FIGS. 1-7, operation of the consist 100 for installation of poles 122 and negative return and ground cables 150 for an electrical traction rail system is described in accordance with an exemplary embodiment. The consist 100 can be loaded with materials and supplies offsite or away from an installation location. Poles 122 may be laid down or stacked within the cargo areas 120 of the pole-setting segment 112, and spools 152 of the cables 150 may be placed in the cargo areas 120 of the cable-deployment segment 116. Alternatively, where the poles 122 are provided in open-top cargo containers 140, the cargo containers 140 may be disposed directly into the cargo areas 120 of the pole-setting segment 112, as depicted in FIG. 4.

Crew members may also load onto the consist 100, such as on the crew-segment 114 where they may be provided with room to change clothes, eat, rest, meet, or the like and/or ride to their destination. Alternatively, crew members may travel to the installation location at a later date or time via other means.

The consist 100 may be coupled to a motive means, such as a power unit or a locomotive, among others and moved to a desired installation location. The consist 100 is positioned with the pole-setting segment 112 located alongside an area in which a plurality of foundations 138 for the poles 122 have been previously installed. In some operations, the foundations 138 may also be installed by operators on the consist 100 or another form of installation may be employed for properly securing the poles 122 in or to the ground. The pole-handling apparatus 124 is used to retrieve a desired pole 122 from within one of the cargo areas 120 of pole-setting segment 112 and to position the pole 122 on the desired foundation 138 or other mounting location. The pole-handling apparatus 124 may be moved longitudinally along the length of the pole-setting segment 112 and/or the consist 100 as needed to achieve the desired position of the pole 122 without need to move the consist 100 as a whole.

Following installation of a number of poles 122 and/or poles 122 that can be reached by the pole-handling apparatus 124, the consist 100 may be moved along the tracks to again position the pole-setting segment 112 alongside a next group of foundations waiting to receive poles 122. Such movement of the consist 100 also positions the cable-deployment segment 116 and the cable-stringing segment 118 alongside the newly installed poles 122 to allow crew members to install the cables 150 onto the newly installed poles 122.

The cable-lifting apparatus 154 is employed to position spools 152 onto the spool station 158 as needed. The cables 150 are strung through the end-arm tool 162 and coupled to an anchor point, which may be one of the poles 122 or another location as is commonly practiced in the art. Meanwhile, crew members utilize the man-lift 166 to install blocks or pulleys on the poles 122 and/or to anchor the cable end as indicated above.

The longitudinal range of motion available to both the cable-lifting apparatus 154 and the man-lift 166 allow the crew members to perform these tasks without requiring movement of the consist 100 or precise positioning thereof. Further, these ranges of motion in combination with the range of motion available to the pole-handling apparatus 124 further increase the accessibility to the desired work areas for functions being performed simultaneously along the consist 100. As such, crew members are able to move their equipment to desired working locations and continue operations without needing to wait until the consist 100 can be moved. In some embodiments, a second vehicle such as an on-highway vehicle fitted with a hi-rail system is provided to follow the consist 100 at a later time or date to finalize any installation operations, such as installing terminations and/or tensioning systems on the cables 150 and replacing the pulleys or blocks on the poles 122 with insulators and landing the cables 150 thereon, among other activities.

During installation operations, the crew members are provided with any necessary facilities, such as restrooms, break or rest spaces, first aid, or the like in the crew-segment 114. Accordingly, crew members can remain on site and do not need to travel to other locations for such services. A crew van (not shown) such as a common automobile fitted with a hi-rail system may be towed behind the consist 100 for transportation of crew members to and from the installation location in case of emergency and at the beginning and end of the work day. As such, the consist 100 may be left at the installation location during non-working hours while the crew is off. The number of vehicles that must travel to and from the installation site daily and stored elsewhere overnight is greatly reduced and may comprise only a single vehicle. Such greatly reduces the likelihood of mishaps, reduces costs for equipment and storage, and streamlines crew activities.

With reference now to FIGS. 8-14, a catenary fabrication and installation consist 200 (hereinafter referred to as the catenary consist 200) is described in accordance with an exemplary embodiment. The catenary consist 200 is generally configured in much the same manner as the pole-setting consist 100 to include a plurality of rail-bound rail-cars 202 coupled together into a single unit or consist. FIGS. 8-14 depict individual segments of the catenary consist 200 which are preferably coupled together in order corresponding to the figure numbers to form the catenary consist 200, but other arrangements may be employed.

Like the pole-setting consist 100, some of the rail-cars 202 of the catenary consist 200 preferably comprise a gondola-style configuration or other style of open top rail car while other portions of the consist may comprise other styled cars, such as flat-cars. Some or all of the cars 202 of the catenary consist 200 also preferably employ the shared-truck configuration and include rails 208 configured to support and enable a wheeled apparatus to travel longitudinally along the sidewalls 206 as well as bridging elements 210 to extend the rails 208 between adjacent ones of the cars 202.

In some embodiments, the catenary consist 200 may be coupled to the trailing end of the pole-setting consist 100. Alternatively, the catenary consist 200 may be operated physically and/or temporally separate from the pole-setting consist 100 and moved along the railway by another propulsion means.

The consist 200 comprises a plurality of segments that are each comprised one or more of the cars 202. Although discussed herein with respect to segments, the consist 200 is a continuous, single unit; segmentation of the consist 200 is merely used herein for clarity and ease of description and is based on the functions performed at different locations along the consist 200. The segments include crew-segments 212 and 214, a termination-installation segment 216, a catenary arm-installation segment 218, an inventory-staging segment 220, a secondary-assembly segment 222, and a primary-fabrication segment 224. It is understood that although the segments and the functions performed thereby are described as being provided in a particular order, such is not intended to be limiting on the scope of exemplary embodiments.

Figure 8A:
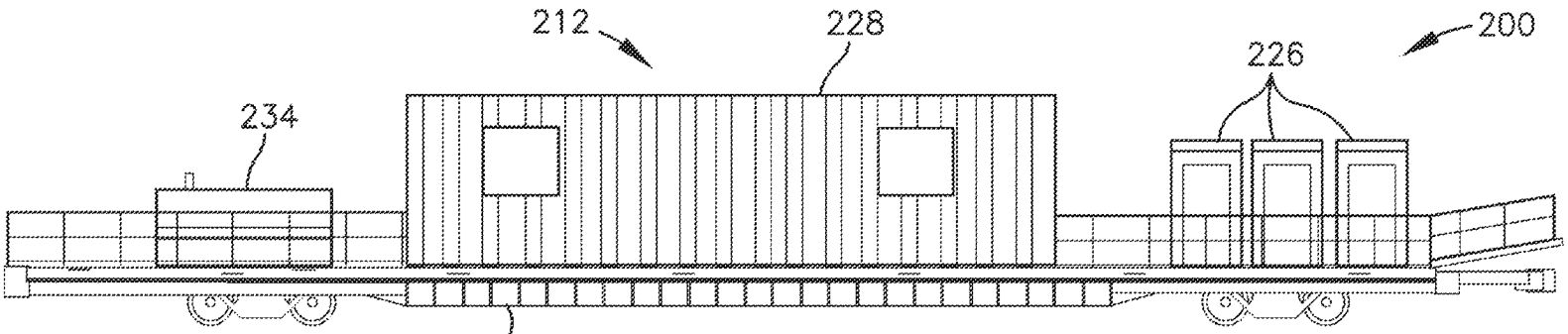
FIGS. 8A-C are a side elevational, top plan, and schematic top plan views, respectively, of a crew-segment of a catenary arm fabrication and installation consist depicted in accordance with an exemplary embodiment.
Figure 8B:
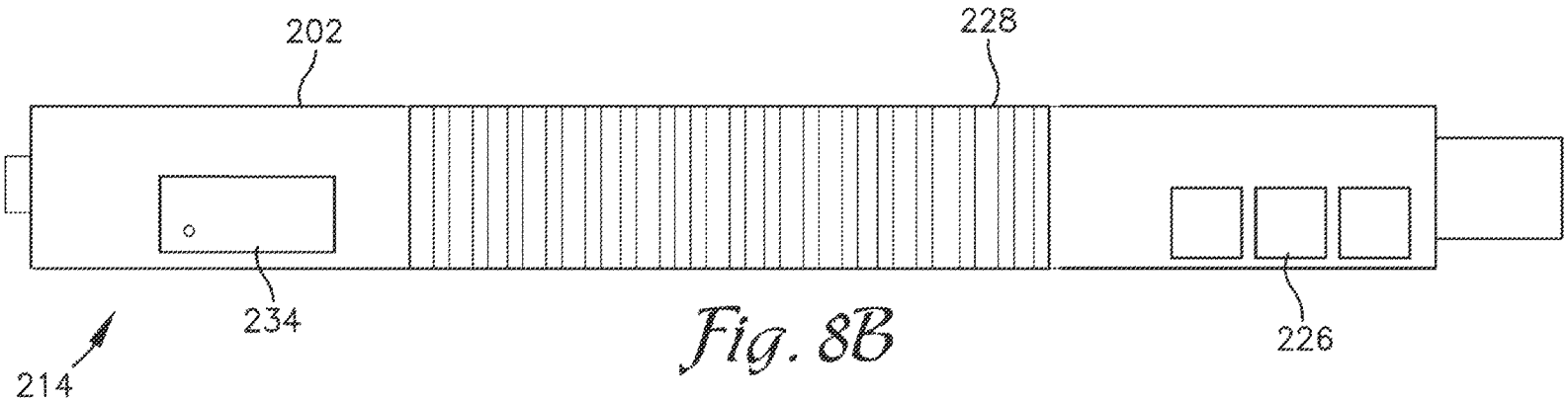
Figure 8C:
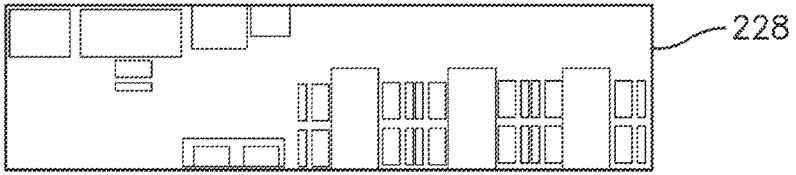
Figure 14A:
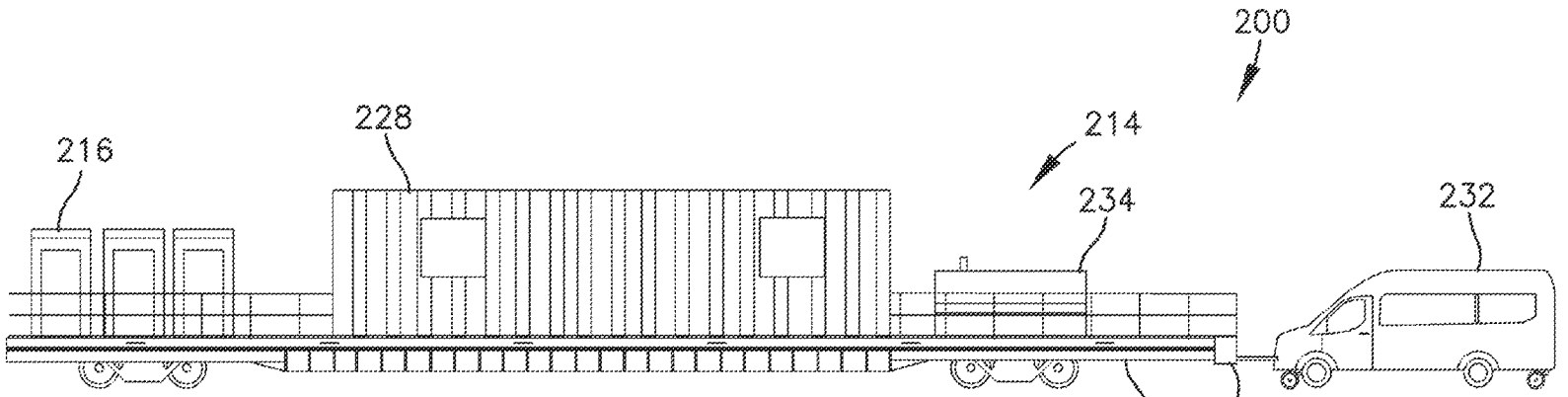
FIGS. 14A-C are side elevational, top plan, and schematic top plan views, respectively, of another crew-segment of a catenary arm fabrication and installation consist depicted in accordance with an exemplary embodiment.
Figure 14B:
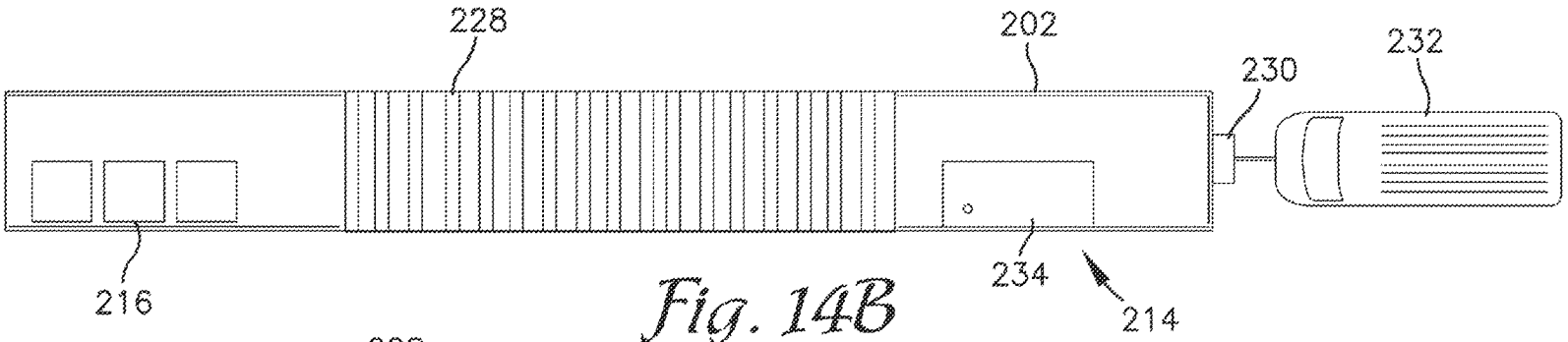
Figure 14C:
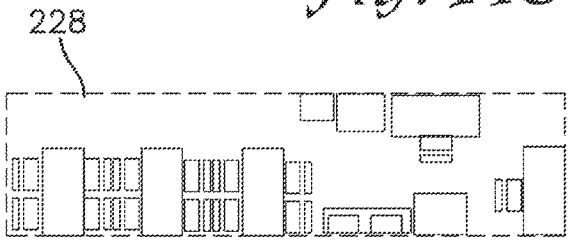

With reference to FIGS. 8A-8C, the crew-segment 212 comprises one or more cars 202 with a variety of accommodations which crew members may inhabit or occupy such as, for example and not limitation, restroom facilities 226 and an enclosed crew quarters 228 which may be configured like the crew quarters 146 described previously. Although only a single crew quarters structure 228 is depicted in the drawings of the crew-segment 212, it is understood that additional structures 228 may be provided and the segment 212 may include additional cars 202 as needed to accommodate such structures 146. With reference to FIGS. 14A-14C, additional crew-segments 214 may be provided along the length or at an opposite end of the catenary consist 200, such as at the trailing end thereof. The crew-segment 214, depicted in FIG. 8 is configured like the crew-segment 212 with restroom facilities 226 and crew quarters 228 and may also include a drawbar 230 for coupling with and towing a highway vehicle 232 adapted for travel on the tracks. The highway vehicle 232 may be used to transport crew members to/from the consist 200 at the start and end of shifts or for emergency situations, among other uses.

Also as depicted in FIGS. 8A, 8B, 14A and 14B, a generator 234 and associated equipment may be provided in the crew-segments 212, 214. The generator 234 and associated components may be employed to provide electrical, hydraulic, pneumatic, and/or mechanical power to the crew-segments 212, 214 and/or to other operations on the consist 200.

Figure 9A:
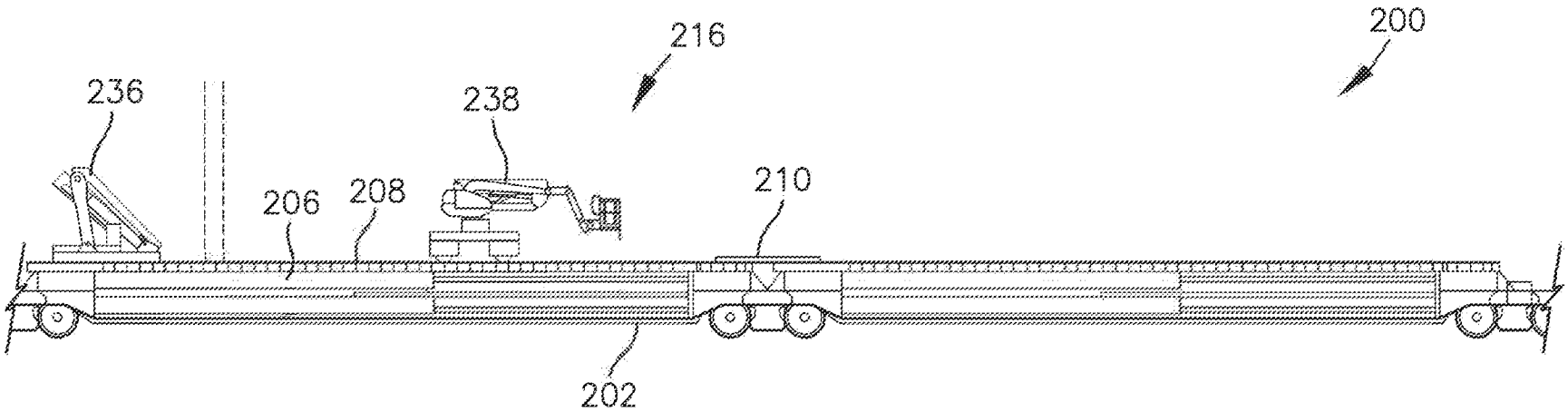
FIGS. 9A-B are side elevational and top plan views, respectively, of a termination-installation segment of a catenary arm fabrication and installation consist depicted in accordance with an exemplary embodiment.
Figure 9B:
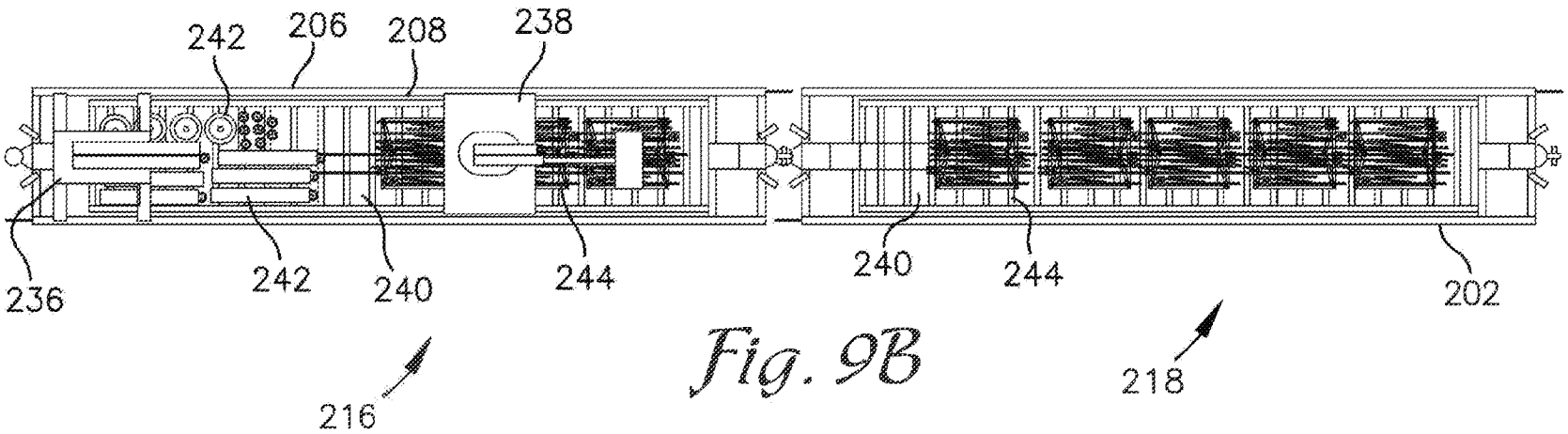

Referring to FIG. 9A and 9B, the termination-installation segment 216 comprises a plurality of cars 202 with a material lift, which in the embodiment shown comprises an articulated lifting boom 236 or similar lifting means mounted or otherwise disposed at a leading end thereof. At least one mobile man-lift 238, adapted for travel longitudinally along the top rails 208 of the sidewalls 206 of the cars 202, may be positioned to travel across the cars 202 and between the catenary-installation segment 218 and the termination-installation segment 216 to position the man-lift 238 proximate the articulated lifting boom 236. The boom 236 is preferably a rigidly mounted knuckle boom that includes a plurality of pivotably coupled segments and a rotatable base mounted to the car 202. In another embodiment, the boom 236 may include a wheeled base and be configured for travel along the rails 208 of the car 202 like the pole-handling apparatus 124 or the cable-lifting apparatus 154 described previously.

The boom 236 is configured to retrieve and lift termination components 242 from within a bay 240 of the car 202 and either dispose the termination components 242 alongside the tracks, near a pole 122, or to raise the components to a desired mounting location on a previously installed pole 122. Such termination components 242 may comprise, for example, balance weight assemblies employed for providing tension on cables of the overhead catenary system and/or other termination components for those cables. As used herein, "termination components" may include either or both balance weight assemblies for providing tension on cables for the overhead catenary system or other components for making connections between terminal ends of adjacently strung sections of cable or for connecting the terminal ends to catenary arms 244 or poles 122 along with other components that may be stored in and/or unloaded from the termination-installation segment 216. The termination components 242 are preferably stored in the bay 240 within operational reach of the boom 236. Bay 240 may also be referred to as a termination component storage space.

Figure 10A:
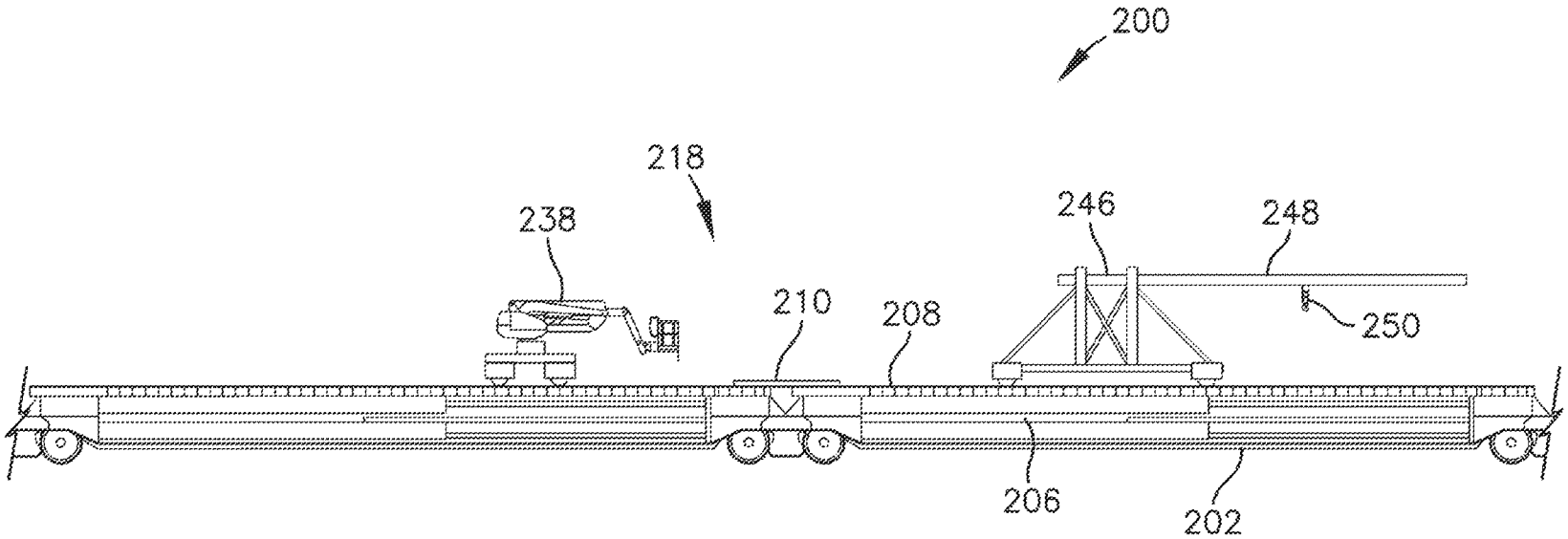
FIGS. 10A-B are side elevational and top plan views, respectively, of a catenary-installation segment of a catenary arm fabrication and installation consist depicted in accordance with an exemplary embodiment.

A plurality of man-lifts 238 may be included on the catenary consist 200 including for example a first manlift 238 shown in FIG. 9A on a gondola car 202 of the termination-installation segment and a second manlift 238 shown in FIG. 10A on a gondola car of the catenary-installation segment 218. It is understood that additional man-lifts 238 could be included in the catenary consist 200 with the number included primarily dependent on the number of gondola cars 202 incorporated into the catenary-installation segment 218. The first man-lift 238

As discussed previously, in the embodiment shown, the first man-lift 238 is positioned and operable to advance between the catenary-installation segment 218 and the termination-installation segment 216 while the second man-lift 238 and any additional man-lifts 238 included on the consist 200 typically only operate on the cars 202 forming the catenary-installation segment 218 although it is foreseen that each of the man-lifts could advance across any of succession of gondola cars 202 of a type which the man-lifts are adapted to traverse. The first manlift 238 may be advanced into close proximity to the boom or material lift 236 such that the first manlift 238 may be operated to position at least one crew member in close proximity to a mounting location for the terminal components 242 to allow installation of the terminal components by the crew member.

Figure 10B:
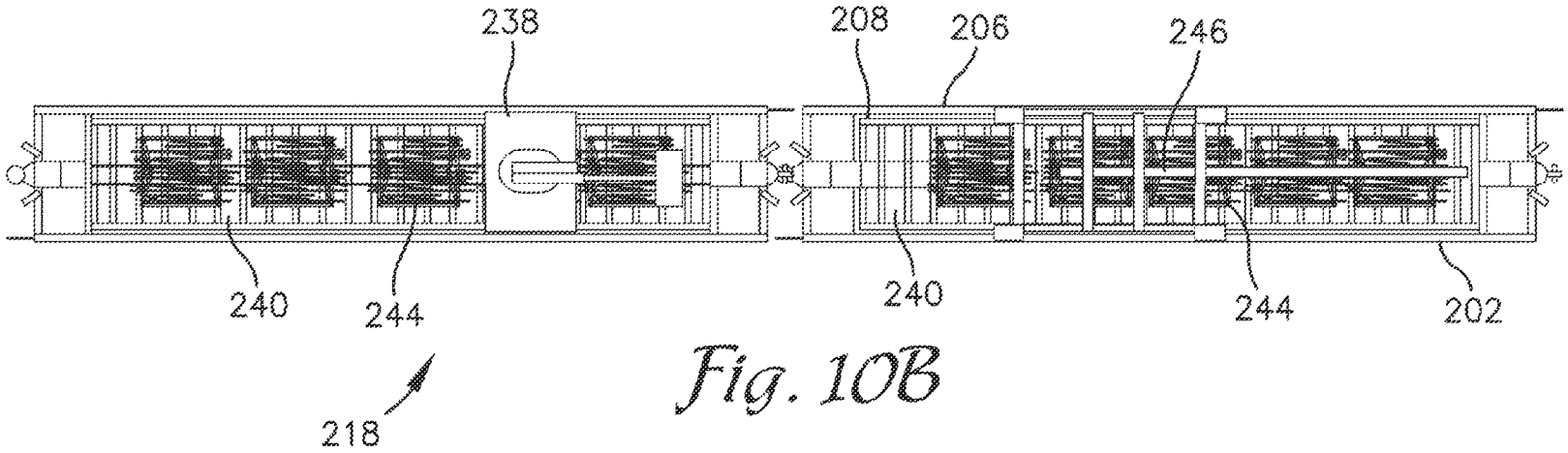

Catenary arms 244 may be stored within the bay 240 of the gondola car 202 forming the termination-installation section 216 as well as in the bays 240 of additional gondola cars 202 forming the catenary-installation segment 218, as depicted in FIGS. 9B and 10B. The prefabricated catenary arms 244 may be disposed on palates, bins, racks or other handling/storage structures with one or more other catenary arms 244 as a group of catenary arms to provide secure storage and to aid movement of the catenary arms 244 along the consist 200.

The man-lifts 238 are configured similarly to the man-lift 166 described previously. The man-lifts 238 provide lifting of one or more crew members to allow installation activities for mounting the catenary arms 244 on the poles or installation of termination components 242 to be carried out. The man-lifts 238 may also provide lifting of the catenary arms 244 from the bays 240 and may include one or more adaptations, such as hooks or other structure on the crew basket to aid securely lifting and handling of the catenary arms 244 during installation. Additionally, the man-lift 238 may be employed to move the catenary arms 244 and other components, such as catenary arm support racks or storage structure within the bays 240 or between cars 202 to aid storage organization and re-utilization of the support racks or storage structure. The longitudinal range of motion along the length of the consist 200 available to the man-lifts 238 allows the crew members to perform their installation tasks without requiring movement of the consist 200 or precise positioning thereof.

The catenary arm-installation segment 218 includes a plurality of cars 202 storing pre-fabricated catenary arms 244 in the bays 240 thereof and at least one man-lift 238 moveably supported on the rails 208 of the sidewalls 206 for use by crew members for installation of the catenary arms 244 and/or organization of the catenary arms 244 or catenary arm storage structure in the bays 240. The segment 218 may also include a mobile gantry crane 246 that is moveable longitudinally the rails 208 of the sidewalls 206 of the cars 202 forming the catenary-installation segment 218 of the consist 200. Longitudinal movement of the mobile gantry crane 246 may be powered or may be manually conducted. The mobile gantry crane 246 includes a longitudinally extending beam 248 with a trolley and hoist 250 disposed thereon. The trolley and hoist 250 may be powered or manually operated to lift and move the catenary arms 244 or groups of the catenary arms supported on racks or the like along the consist 200 as needed, but typically such movement is toward the catenary arm-installation segment 218 and the termination-installation segment 216, e.g. toward the crews engaged in installing the catenary arms 244. In another embodiment, the mobile gantry crane 246 is replaced or aided by provision of another man-lift 238 or another lifting apparatus configured for travel along the rails 208 of the sidewalls 206, e.g. a forklift or an apparatus similar to the pole-handling apparatus 124.

Figure 11A:
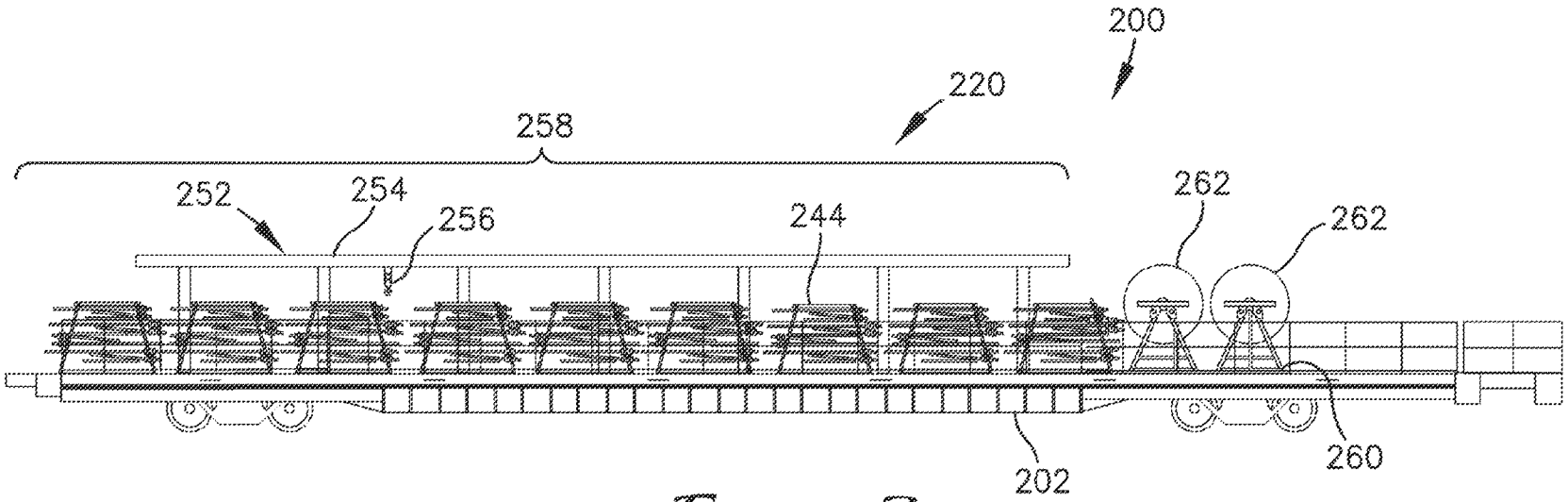
FIGS. 11A-B are side elevational and top plan views, respectively, of an inventory-staging segment of a catenary arm fabrication and installation consist depicted in accordance with an exemplary embodiment.
Figure 11B:
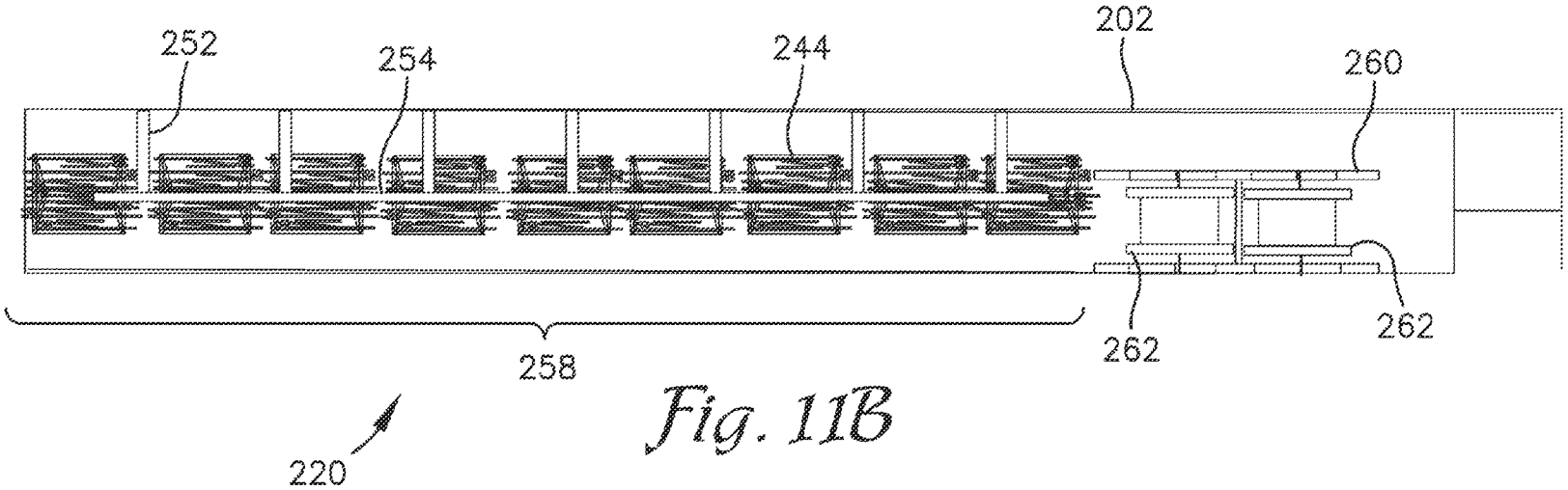

With reference now to FIGS. 11A-B, the inventory-staging segment 220 comprises one or more cars 202 configured for storage and staging of the catenary arms 244 following fabrication thereof and until installation or until storage space is made available on the catenary-installation segment 218 or the termination-installation segment 216. The cars 202 of the inventory-staging segment 220, as depicted in FIGS. 11A-B comprise flat-bed cars that employ standard couplings therebetween however they may also be configured as discussed previously to comprise gondola cars with standard couplings or shared trucks, among other car configurations.

A stationary gantry system 252 is provided on the inventory-staging segment 220 which includes a longitudinally extending beam 254 on which a trolly and hoist 256 are disposed and can travel therealong and which is suspended above a deck of the car 202 above a material staging area 258. In embodiments in which the inventory-staging segment 220 comprises more than one car 202, the stationary gantry system 252 may include a bridging component (not shown) to allow travel of the trolly and hoist 256 between the beams 254 of adjacent cars 202 or another apparatus may be provided to move materials between the cars 202. Similarly, in some embodiments, the beam 248 of the mobile gantry crane 246 on the catenary arm-installation segment 218 is configured to allow transfer of materials between it and the stationary gantry system 252. In some embodiments, the trolly and hoist 250 may move onto the stationary gantry system 252 or the trolly and hoist 256 may move onto the mobile gantry crane 246, or vice versa. Alternatively, the available working area of the mobile gantry crane 246 may overlap with that of the stationary gantry system 252 such that materials can be transferred from the stationary gantry system 252 to the mobile gantry crane 246 and further transferred forward along the consist 200.

The trolly and hoist 256 of the stationary gantry system 252 may be manually operated or may be configured for powered operation, e.g. electrical operation. The material staging area 258 provides space in which the prefabricated catenary arms 244 may be stored individually or in groups which may be disposed on pallets or other storage bases or bins to aid movement thereof.

The inventory-staging segment 220 may also provide storage locations and/or structures 260 for storage of one or more coils 262 of cable. The structures 260 may comprise stands configured to hold the coils 262 and may enable and/or aid rotation thereof to play out the cables for distribution thereof. The cables may comprise any desired cables used in the installation process of the overhead catenary system, but typically include cable used for guy wires to be installed on the poles 122.

Figure 12A:
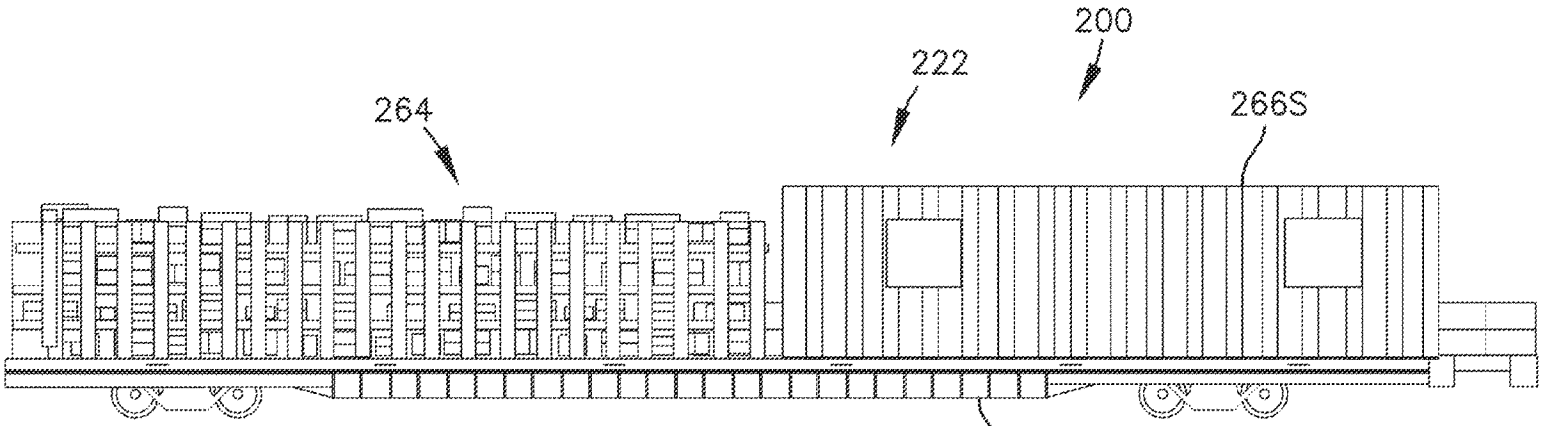
FIGS. 12A-C are side elevational, top plan, and schematic top plan views, respectively, of a secondary-assembly segment of a catenary arm fabrication and installation consist depicted in accordance with an exemplary embodiment.
Figure 12B:
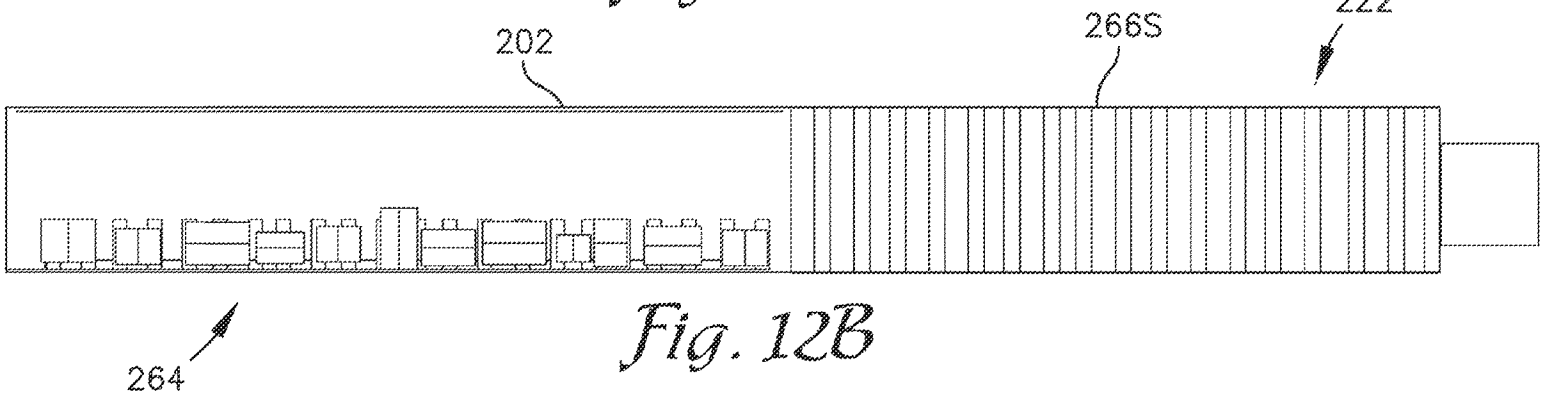
Figure 12C:
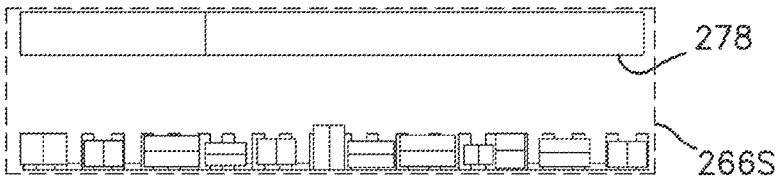

Referring now to FIGS. 12A-12C and 13A-13C, the catenary arms 244 may be constructed on the catenary consist 200 on the primary-fabrication segment 224 (FIGS. 13A-13C) and the secondary-assembly segment 222 (FIGS. 12A-12C). Both the primary-fabrication segment 224 and the secondary-assembly segment 222 may include one or more cars 202 that employ a flat-bed configuration, as depicted in FIGS. 12A-12C and 13A-13C, or another configuration like the cars 102 and 202 described previously.

Figures 13A, 13B, 13C:
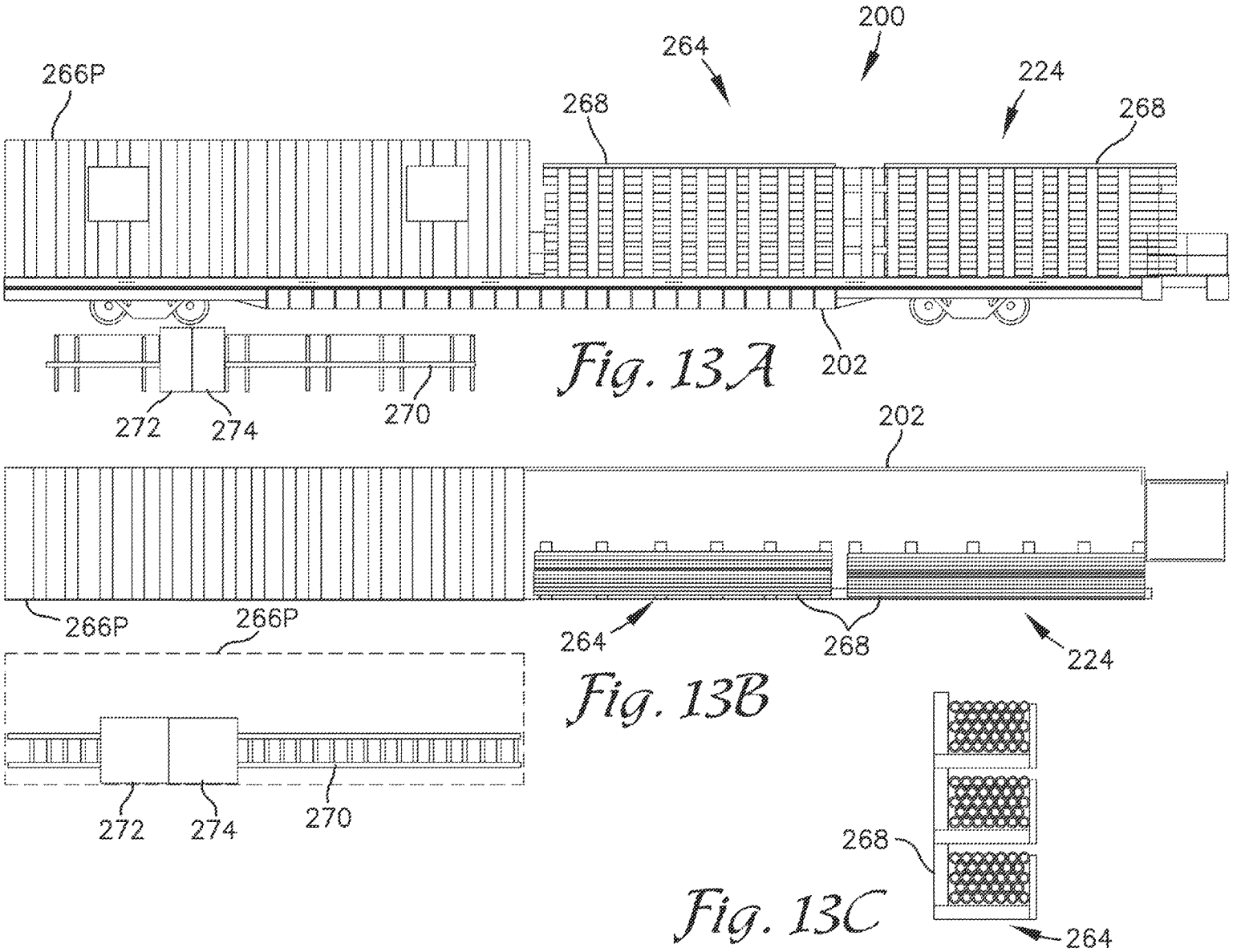
FIG. 13A-B are side elevational and top plan views, respectively, of a primary-fabrication segment of a catenary arm fabrication and installation consist depicted in accordance with an exemplary embodiment.
FIG. 13C is an end elevational view of a pipe storage rack disposed on the primary-fabrication segment of FIGS. 13A-B depicted in accordance with an exemplary embodiment.

The segments 224 and 222 both include material-storage facilities 264 which may comprise shelving, racks, or the like and a fabrication cabin 266*p*, 266*s*. The segments 224 and 222 are arranged to aid material and fabrication flow from a trailing end of the consist 200 forward along the consist 200 such that the raw materials generally enter from the trailing end of the consist 200; the completed catenary arms 244 leave toward the forward end of the secondary-assembly segment 222 and move to the inventory-staging segment 220. As such, the material-storage facilities 264 of the primary-fabrication segment 224 may comprise racks 268 configured to store lengths of structural pipe which will be cut to length and assembled into the catenary arms 244. As depicted in FIG. 13C the racks 268 may be configured with removeable support bars or similar components to ease loading of the pipe onto the racks 268 via fork-lift or similar loading devices. Similarly, the material-storage facilities 264 of the secondary-assembly segment 222 provide storage of supplies and components to be used to assembly the pipe into the catenary arms 244 as well as components to be mounted thereon.

The fabrication cabins 266*p*, 266*s* comprise enclosures disposed on or mounted to the respective cars 202 that house facilities and equipment useable by crew members for fabricating and assembling the catenaries 202 on the consist 200. The fabrication cabins 266*p*, 266*s* may be formed from shipping containers used in the shipping industry that are modified and disposed on the cars 202 or they can be custom built as needed. As depicted in FIGS. 13A-B, the fabrication cabin 266*p* of the primary-fabrication segment 224 may include a roller table 270, a saw 272, and a drill 274, among other equipment that are adapted to aid crew members in cutting and drilling the pipe as needed for fabrication of the catenary arms 244. The fabrication cabin 266*s* of the secondary-assembly segment 222 may include a variety of storage shelving 276, racks, or the like and one or more workstations 278 at which crew members can assemble the catenary arms 244. Each of the fabrication cabins 266*p*, 266*s* include doorways and/or passages in longitudinal endwalls thereof (not shown) to allow crew and materials to be transported into the fabrication cabins 266*p*, 266*s* as well as longitudinally along the length of the consist 200. Similarly, the material-storage facilities 264 are also positioned to aid and enable the flow of materials longitudinally along the consist 200.

With continued reference to FIGS. 8-14, operation of the catenary consist 200 is described in accordance with an exemplary embodiment. Raw materials and components can be loaded onto the consist 200 prior to and/or along the route of transport or operation of the consist 200. Structural pipe can be loaded onto the racks 268 via, for example, a forklift and in sufficient quantities to complete a desired build out or portion thereof of an overhead catenary system. Similarly, any needed components and supplies used to assemble the catenary arms 244 can be loaded onto the storage shelves 276 of the secondary-assembly segment 222. If additional storage is needed or desired, either or both of the secondary-assembly segment 222 and the primary-fabrication segment 224 may include additional cars 202 outfitted with additional material-storage facilities 264 such as racks 268, storage shelves 276 or the like. In some embodiments, the termination-installation segment 216 might also be loaded with the termination components 242, including weighted tension assemblies and cable terminations.

The catenary arms 244 are typically of different dimensions and configurations depending on the characteristics of the location of the pole 122 on which the arms are to be installed. The termination-installation segment 216, the catenary-installation segment 218, and the inventory-staging segment 220 can be loaded with pre-assembled catenary arms 244 marked or labeled for installation on poles 122 at specified locations. The catenary arms 244 may be stored, labeled, or otherwise staged and tracked on the consist 200 to aid the flow of materials during installation and the proper installation of the particular catenary arm 244 in the intended location. For example, the catenary arms 244 may be stored in order of intended installation location.

In some embodiments, a standardized catenary configuration may be employed on poles at some locations of an overhead catenary system and only non-standard catenary arms 244 are fabricated on the consist 200 for the remaining poles 122 based on particular characteristics of particular installation locations. In another embodiment, all the catenary arms 244 to be installed using the consist 200 are fabricated on the consist 200. In yet another embodiment, the consist 200 may be loaded with a number of catenary arms 244 that are either standardized or specially configured for particular locations along the installation and a number of additional catenary arms 244, standardized and/or specially configured, may be fabricated on the consist 200 to replenish inventory and/or to increase the range of the consist's installation activities before needing to be reloaded.

Production of the catenary arms 244 begins on the primary-fabrication segment 224 on which tools for fabricating the catenary arms 244 may be stored or otherwise provided. Tubing is retrieved from the racks 268 and loaded onto the roller table 270 in the fabrication cabin 266P where it can be cut to into desired lengths and drilled as needed using the saw 272 and drill 274 or other tools as needed. The cut and drilled tubing may be transferred to the fabrication cabin 266S of the secondary-assembly segment 222 where crew members assemble the tubing to form the catenary arms 244. Materials needed for assembly of the catenary arms 244 (e.g. bolts, couplers, or the like) as well as additional components to be mounted thereon (e.g. insulators, hangers, mounting hardware, or the like) may be retrieved from the storage shelves 276. Crew members may utilize the workstations 278 for the assembly.

The completed catenary arms 244 may be carried forward along the consist 200 to the inventory-staging segment 220, either manually or utilizing a mobile lifting device or crane, where they may be loaded as groupings of catenary arms on pallets, racks or similar storage bases, bins, or the like which are positioned within the operational reach of the stationary gantry system 252.

The hoist 256 of the stationary gantry system 252 lifts and moves the groups of catenary arms 244 forward along the length of the inventory-staging segment 220 toward the catenary-installation segment 218. The stationary gantry system 252 may have sufficient vertical range to enable the groups of catenary arms 244 to be moved vertically over one another to enable reordering thereof or the system 252 may be employed to simply move the groups of catenary arms 244 forward in stepwise fashion.

The mobile gantry crane 246 is moved rearward along the consist 200 to pick up a forward-most group of catenary arms 244 on the inventory-staging segment 220. The mobile gantry crane 246 is moveable forward along and between cars 202 of the catenary-installation segment 218 to dispose or deposit the selected group of catenary arms 244 in a desired location within the bay 240 of a selected one of the cars 202. The mobile gantry crane 246 and the stationary gantry system 252 proceed to move the catenary arms 244 or groups of catenary arms 244 forward along the consist 200 to provide an available supply of catenary arms 244 to crews working to install the catenary arms 244 from the catenary-installation segment 218 and the termination-installation segment 216.

The installation crews working on the catenary-installation segment 218 and/or the termination-installation segment 216 retrieve the catenary arms 244 from the bays 240 of their respective cars 202 and, using the manlifts 238, raise the catenary arms 244 to the desired locations on the pre-installed poles alongside the consist 200. Mobility of the manlifts 238 relative to the consist 200 aids such installation because the crews can easily obtain a desired position irrespective of other crews operating on the consist. For example, where spacing between the poles is inconsistent the crews can easily adapt their positions along the consist to accommodate such spacing. Similarly, the crews may be able to complete multiple installations or installation tasks without need to move the consist 200.

When a termination point is reached, i.e. when a location at which a balance weight assembly or other termination is to be installed is reached, crews may use the boom 236 to retrieve the termination components 242 of the termination assembly from the bay 240 and lift the components 242 to a position proximate an installation location of the components 242. The first manlift 238 may be operated and moved to position the one or more crew members proximate the installation location to allow the crew members to install the termination components on or near the catenary pole 122 associated with the termination point Meanwhile, other crews may continue installation of additional catenary arms 244 and/or the additional time that may be needed for installation of the termination may be used to complete other tasks on the consist 200. For example, crews may collect and return empty pallets or bins from the bays 240 of the termination-installation segment 216 and catenary-installation segment 218 to the inventory-staging segment 220 for reloading with additional catenary arms 244. Or the other crews may proceed to fabricating additional catenary arms 244 for installation once the consist 200 resumes movement along the railway. Upon achieving a desired state of completion of the termination installation, the consist 200 may be moved further along the railway to enable further catenary arm 244 installation.

At any point in time as desired or required, the crew members may access the crew-segments 212, 214. As discussed previously, the crew-segments 212, 214 can provide any desired or necessary facilities, such as restrooms, break or rest spaces, first aid, or the like. Accordingly, crew members can remain on site and do not need to travel to other locations for such services. The highway vehicle 232, such as a common automobile fitted with a hi-rail system may be towed behind the consist 200 for transportation of crew members to and from the installation location in case of emergency, at the beginning and end of the workday, or for any other reason. As such, the consist 200 may be left at the installation location during non-working hours while the crew is off. The number of vehicles that must travel to and from the installation site daily and stored elsewhere overnight is greatly reduced and may comprise only a single vehicle. Such greatly reduces the likelihood of mishaps, reduces costs for equipment and storage, and streamlines crew activities.

Many different arrangements of the various components depicted, as well as components not shown, are possible without departing from the scope of the description provided herein. Exemplary embodiments have been described with the intent to be illustrative rather than restrictive. Alternative embodiments will become apparent to readers of this disclosure after and because of reading it. Alternative means of implementing the aforementioned can be completed without departing from the scope of exemplary embodiments described herein. Identification of structures as being configured to perform a particular function in this disclosure is intended to be inclusive of structures and arrangements or designs thereof that are within the scope of this disclosure and readily identifiable by one of skill in the art and that can perform the particular function in a similar way. Certain features and sub-combinations are of utility and may be employed without reference to other features and sub-combinations and are contemplated within the scope of exemplary embodiments described herein.

What is claimed is:

1. A consist for installing components of an overhead catenary system for railways comprising:

a catenary-installation segment comprising at least one catenary-installation segment rail car having a catenary arm storage space formed between sidewalls for storing a plurality of catenary arms to be installed;

a termination-installation segment comprising at least one termination-installation segment rail car, the at least one termination-installation segment rail car comprising an open top rail car including a termination component storage space formed between longitudinally extending sidewalls for storing a plurality of catenary cable termination components;

a first lift mounted on the termination-installation segment and adapted to raise at least one of the plurality of catenary cable termination components for installation; and a second lift configured to travel longitudinally along the sidewalls of the at least one catenary-installation segment rail car to raise at least one crew member and a selected one of the plurality of catenary arms for installation on a pre-installed pole alongside the consist, and the second lift is advanceable onto the longitudinally extending sidewalls of the at least one termination-installation segment rail car proximate the first lift to position the at least one crew member to install the catenary cable termination components lifted by the first lift.

2. The consist as in claim 1 wherein:

the at least one catenary-installation segment rail car comprises a plurality of open top rail cars with the catenary arm storage space formed therein between the sidewalls thereof; and the consist further comprises a third lift, the second and third lifts are each configured to travel along the sidewalls of the open top rail cars and to raise at least one crew member and a selected one of the plurality of catenary arms for installation on a pre-installed pole alongside the consist.

3. The consist as in claim 2 further comprising:

an inventory-staging segment comprising at least one staging segment rail car having a catenary arm staging space for storing a plurality of catenary arms in groups and a stationary gantry crane on the at least one staging segment rail car for moving the groups of the plurality of catenary arms along the staging segment rail car.

4. A consist for installing components of an overhead catenary system for railways comprising:

a catenary-installation segment comprising a plurality of catenary-installation segment rail cars each having a catenary arm storage space formed between sidewalls for storing a plurality of catenary arms to be installed;

a termination-installation segment comprising at least one termination-installation segment rail car, the termination-installation segment including a termination component storage space for storing a plurality of catenary cable termination components;

a first lift mounted on the termination-installation segment and adapted to raise at least one of the plurality of catenary cable termination components for installation; and a second lift and a third lift each configured to travel longitudinally along the sidewalls of the plurality of catenary-installation segment rail cars to raise at least one crew member and a selected one of the plurality of catenary arms for installation on a pre-installed pole alongside the consist a mobile crane configured to travel longitudinally along the sidewalls of the plurality of catenary-installation segment rail cars and retrieve and move groups of the plurality of catenary arms from the catenary arm staging space and deposit groups of the plurality of catenary arms in the catenary arm storage space of the plurality of catenary-installation segment rail cars of the catenary-installation segment and an inventory-staging segment comprising at least one staging segment rail car having a catenary arm staging space for storing a plurality of catenary arms in groups and a stationary gantry crane on the at least one staging segment rail car for moving the groups of the plurality of catenary arms along the staging segment rail car.

5. The consist as in claim 4 wherein each group of catenary arms comprises a plurality of catenary arms supported on a storage base or bin.

6. The consist as in claim 1 further comprising:

a primary-fabrication segment including fabrication storage space for storing catenary arm fabrication materials from which catenary arms may be fabricated and a fabrication workspace housing tools for fabricating catenary arms from the catenary arm fabrication materials.

7. A consist for installing components of an overhead catenary system for railways comprising:

a catenary-installation segment comprising a plurality of open top rail cars each having a catenary arm storage space formed between longitudinally extending sidewalls for storing a plurality of catenary arms to be installed;

a termination-installation segment comprising at least one termination-installation segment rail car, the at least one termination-installation segment rail car comprising an open top rail car having a termination component storage space formed between longitudinally extending sidewalls for storing a plurality of catenary cable termination components;

a first lift mounted on the termination-installation segment and adapted to raise at least one of the plurality of catenary cable termination components for installation; and a second lift and a third lift, the second and third lifts are each configured to travel along the sidewalls of the open top rail cars of at least the catenary-installation segment to raise at least one crew member and a selected one of the plurality of catenary arms for installation on a pre-installed pole alongside the consist, wherein:

the open top rail cars of the termination-installation segment and of the catenary-installation segment include rails mounted along the longitudinally extending sidewalls thereof configured to enable a wheeled apparatus to move longitudinally therealong; and wherein the second and third lifts are mounted on flanged wheels for engaging the rails for longitudinal advancement relative thereto.

8. The consist as in claim 1 wherein the first lift comprises an articulated lifting boom mounted on the termination-installation segment.

9. The consist as in claim 8 wherein the articulated lifting boom is mounted proximate a distal end of the termination-installation segment.

10. A consist for installing components of an overhead catenary system for railways, the consist comprising a plurality of rail-bound cars coupled together to form a single unit, one or more of the cars including rails mounted along longitudinal sidewalls thereof and configured to enable a wheeled apparatus to move longitudinally therealong, the cars of the consist being grouped to provide:

a primary-fabrication segment including storage facilities for materials from which catenary arms may be fabricated;

a secondary-assembly segment including storage facilities for components for assembling the materials into the catenary arm and components to be mounted thereon, and a fabrication cabin including a workstation adapted for use by a crew member for fabricating the catenary arm;

an inventory-staging segment having a stationary gantry system configured to move one or more of the catenary arms longitudinally along the inventory-staging segment and having storage space for storing the catenary arms;

a catenary-installation segment having a mobile gantry crane configured to move along the catenary-installation segment to move the catenary arms longitudinally from the inventory-staging segment onto and along the catenary-installation segment, and having a first manlift configured to travel along the catenary-installation segment to raise at least one crew member and a selected catenary arm for installation on a pre-installed pole alongside the consist; and a termination-installation segment having a material lift disposed thereon for lifting termination components for installation; and wherein the consist further includes:

a second manlift configured to travel along the catenary-installation segment and the termination-installation segment to raise at least one crew member for installation of a selected catenary arm on a pre-installed pole alongside the consist or for installation of termination components.

11. The consist as in claim 10 wherein the material lift comprises an articulated lifting boom.

12. The consist as in claim 11 wherein the articulated lifting boom is mounted proximate a distal end of the termination-installation segment.

13. A method for installing catenary system components on pre-installed poles for a catenary system comprising the steps of:

a) providing a consist comprising a plurality of rail-bound cars coupled together to form a single unit, the cars of the consist being grouped to provide:

a catenary-installation segment comprising at least one catenary-installation segment rail car having a catenary arm storage space for storing a plurality of catenary arms;

a termination-installation segment comprising at least one termination-installation segment rail car, the at least one termination-installation segment rail car comprising an open top rail car including a termination component storage space formed between longitudinally extending sidewalls for storing a plurality of termination components;

b) providing a material lift disposed on the termination-installation segment for lifting termination components for installation;

c) providing at least a first manlift configured to travel along the catenary-installation segment to raise at least one crew member and a selected catenary arm for installation on a pre-installed pole alongside the consist the first manlift is advanceable onto the longitudinally extending sidewalls of the at least one termination-installation segment rail car proximate the material lift to position the at least one crew member to install the termination components lifted by the material lift;

d) positioning a plurality of catenary arms in the catenary arm storage space of the at least one catenary-installation segment rail car;

e) moving the consist along a section of a railroad track to a desired location having one or more previously installed catenary poles to which catenary arms are to be attached to position the catenary-installation segment adjacent to the one or more poles;

f) operating the first manlift to raise at least one crew member and a selected catenary arm and position the at least one crew member and the selected catenary arm proximate a pre-installed pole of the catenary system such that the at least one crew member may connect the selected catenary arm to the pre-installed pole;

g) operating the material lift to raise at least one of the plurality of termination components to proximate an installation location for the termination components proximate one of the previously installed catenary poles; and h) operating the first manlift to travel across the termination-installation segment and position the at least one crew member proximate the installation location to allow installation of the termination components by the at least one crew member.

14. The method as in claim 13 further comprising:

a) providing a second manlift configured to travel along the catenary-installation segment to raise at least one crew member and a selected catenary arm for installation on a pre-installed pole alongside the consist.

15. A method for installing catenary system components on pre-installed poles for a catenary system comprising the steps of:

a) providing a consist comprising a plurality of rail-bound cars coupled together to form a single unit, the cars of the consist being grouped to provide:

a catenary-installation segment comprising at least one catenary-installation segment rail car having a catenary arm storage space for storing a plurality of catenary arms;

a termination-installation segment comprising at least one termination-installation segment rail car, the termination-installation segment including a termination component storage space for storing a plurality of termination components;

b) providing a material lift disposed on the termination-installation segment for lifting termination components for installation;

c) providing a first manlift configured to travel along the catenary-installation segment to raise at least one crew member and a selected catenary arm for installation on a pre-installed pole alongside the consist;

d) providing a second manlift configured to travel along the catenary-installation segment to raise at least one crew member and a selected catenary arm for installation on a pre-installed pole alongside the consist;

e) positioning a plurality of catenary arms in the catenary arm storage space of the at least one catenary-installation segment rail car;

f) moving the consist along a section of a railroad track to a desired location having one or more previously installed catenary poles to which catenary arms are to be attached to position the catenary-installation segment adjacent to the one or more poles;

g) operating the first manlift to raise at least one crew member and a selected catenary arm and position the at least one crew member and the selected catenary arm proximate a pre-installed pole of the catenary system such that the at least one crew member may connect the selected catenary arm to the pre-installed pole;

h) operating the material lift to raise at least one of the plurality of termination components to proximate an installation location for the termination components proximate one of the previously installed catenary poles; and i) operating the first manlift to travel across the termination-installation segment and position the at least one crew member proximate the installation location to allow installation of the termination components by the at least one crew member;

j) providing an inventory-staging segment comprising at least one staging segment rail car having a catenary arm staging space; and k) positioning a plurality of catenary arms in the catenary arm staging space.

16. The method as in claim 15 further comprising:

a) selectively moving the plurality of catenary arms from the catenary arm staging space to the catenary arm storage space of the at least one catenary-installation segment rail car.

17. The method as in claim 16 further comprising:

a) providing a catenary arm fabrication segment having materials and tools for fabricating catenary arms stored thereon; and b) fabricating a plurality of catenary arms on the catenary arm fabrication segment from the materials and tools stored thereon; and c) moving the plurality of catenary arms from the catenary arm fabrication segment on which they were fabricated to the catenary arm staging space on the inventory-staging segment.

* * * * *